US006419171B1

(12) United States Patent
Takayanagi

(10) Patent No.: US 6,419,171 B1
(45) Date of Patent: Jul. 16, 2002

(54) STATIC ELIMINATOR

(75) Inventor: Makoto Takayanagi, Hamamatsu (JP)

(73) Assignee: Takayanagi Research Inc., Shizuoka (JP)

( * ) Notice: Subject to any disclaimer, the term of this patent is extended or adjusted under 35 U.S.C. 154(b) by 0 days.

(21) Appl. No.: 09/479,787

(22) Filed: Jan. 7, 2000

(30) Foreign Application Priority Data

| | | |
|---|---|---|
| Feb. 24, 1999 | (JP) | 11-046828 |
| Apr. 19, 1999 | (JP) | 11-110543 |
| May 31, 1999 | (JP) | 11-151489 |
| Jun. 1, 1999 | (JP) | 11-153501 |
| Jul. 7, 1999 | (JP) | 11-192495 |
| Aug. 5, 1999 | (JP) | 11-221959 |
| Aug. 5, 1999 | (JP) | 11-221960 |

(51) Int. Cl.[7] ..... B05B 5/00; B05B 7/02; F23D 11/32; A62B 18/00

(52) U.S. Cl. ..... 239/690; 239/690.1; 239/706; 239/270; 239/526

(58) Field of Search ..... 361/212, 220, 361/229, 234, 231, 213; 239/690, 690.1, 706, 708, 270, 526, 525

(56) References Cited

U.S. PATENT DOCUMENTS

| | | | | |
|---|---|---|---|---|
| 3,156,847 A | * | 11/1964 | Schweriner | 317/4 |
| 4,092,543 A | * | 5/1978 | Levy | 250/423 R |
| 4,188,530 A | * | 2/1980 | Miller | 250/324 |
| 4,665,462 A | * | 5/1987 | Blitshteyn et al. | 361/213 |
| 5,153,811 A | * | 10/1992 | Rodrigo et al. | 361/231 |

* cited by examiner

*Primary Examiner*—William Doerrler
*Assistant Examiner*—Davis Hwu
(74) *Attorney, Agent, or Firm*—Leighton K. Chong

(57) ABSTRACT

There is a wear-type of static eliminator which comprises a static eliminator body attachable to the human body, and a discharge section disposed within said remover body to issue ions toward the human body, Also there is a static potential measuring instrument which comprises: a plus discharge needle for use in plus ion discharge, a minus discharge needle for use in minus ion discharge, a current source for generating a current supplied to said plus discharge and minus discharge needles, a plus current ammeter for measuring a current flowing from said current source to said plus discharge needle, a minus current ammeter for measuring a current flowing from said current source to said minus discharge needle, means of calculating the difference between absolute values of currents obtained by said ammeters, the ratio of one absolute value of current obtained by one of said ammeter to the other absolute value of current obtained by the other of said ammeter or both the difference and the ratio, and a measuring terminal connected, to said current source.

8 Claims, 24 Drawing Sheets

STATIC ELIMINATOR

BACKGROUND OF THE INVENTION

This invention relates to a static eliminator.

Static electricity is eliminated or removed as a harmful object in the industrial field where a semiconductor is handled or a surface treatment such as coating, plating, or evaporating is conducted. Conventional static electricity eliminating or removing instruments or tools, hereinafter referred to as static eliminator, will be explained below.

(1) Ionizer:

The ionizer ionizes an air and sprays out or issues out ions. The ionizer is attached to the machine to eliminate or remove static electricity from the work, or is held and moved by the operator to remove electricity from the work. In the former case, the work is put on the working table to which the ionizer is attached, and the ionizer is caused to issue ions toward the work and remove electricity from the work. In the latter case, the operator holds the ionizer so as to direct the ions from the ionizer toward the work and remove electricity from the work.

(2) Wrist Strap:

The wrist strap or conductive band is tied on the wrist of the operator to remove electricity from the human body. This is merely to remove electricity from the operator who sits at a working table on which the work is put, and electricity cannot be removed from the walking operator. Actually, the operator sometimes walks around without the wrist strap. Therefore, for the next operation, the operator would forget to tie the wrist strap on his wrist. Furthermore, the wrist straps are connected to the ground at the earth points by the electric wires. However, since the wires are connected to the wrist straps through many junctions, many accidents would be caused.

(3) Anti-static Electricity Clothes:

The operator wears clothes on which less static electricity is generated to prevent the generation of static electricity. The clothes can reduce the generation of static electricity, but cannot remove the generated electricity.

(4) Conductive Shoes:

The shoes which are used during the operation are made to be conductive, The shoes transfer the static electricity generated on the human body to the conductive floor. In this case, the conductive floor is required and the ordinary floor or non-conductive floor is not effective.

(5) Passive Electricity Removing Tool:

(a) Ring type

The ring type of the electricity removing tool is fit on the finger of the operator for use. The tool discharges the electric charges to escape the charges in the air when the charges are accumulated above a static potential, and then lowers the static potential. However, since the discharge of the electricity removing tool stops when the charges lowers below a certain static potential, the removing tool cannot remove a low static potential.

(b) Wrist watch type

The wrist watch type of the electricity removing tool is fit on the wrist of the operator for use. The tool discharges the electric charges to escape the charges in the air when the charges are accumulated above a static potential, and then lowers the static potential. However, since the discharge of the electricity removing tool stops when the charges lowers below a static potential, the removing tool cannot remove a relative low static potential.

Even when one of these electricity removing instruments or tools is used, electricity removement is rather difficult in the following cases. For example, when the operator walks around, the clothes causes the friction therebetween and then the electricity is generated to be accumulated on the human body. If the socks are made of conductive fibers, shoes are conductive, and the floor is conductive, the accumulated static electricity can escape from the human body. However, since in general the operator is not in a such environment, there are problems to be solved. For example, when the operator bearing charges touches the work, the work is electrically attacked and then broken. For another example, the dust on which the charge is accumulated is transferred to the work and then causes damage to the work. As mentioned above, conventionally, a perfect method of removing electricity from the walking operator was not present.

Furthermore, an air tool such as a cutter or buff is used when a big object such as a plastic ship body is machined, e.g. is cut or is ground. Since an air hose which connects an air source to the air tool is usually made of an insulator material where static electricity does not escape, the static electricity generated due to the friction during machining is accumulated on the human body through the air hose. As the static electricity or electric charge is accumulated up to a certain level, the discharge is abruptly caused toward the floor to give a big electric attack to the operator. In such a case, since the operator walks around, there is no perfect method of removing electricity.

A conventional ionizer includes an air-blow gun type of electricity. As shown in FIG. 43, The conventional air-blow gun type of static eliminator 600 is constructed so that an air blow bun is provided with an electric section, that is, a discharge electrode of ionizer. The air-blow gun comprises a cylindrical gun body 602 through which a compressed air is flowed, an air hose 604 through which the compressed air is supplied to the gun body 602, and air nozzle 606 provided at the leading end of the gun body 602.

The air blow gun is provided with a discharge electrode section 608 which comprises a cylindrical insulator 608*a* provided between the gun body 602 and the air nozzle 606. and a discharge needle 608*b* disposed on the center of the cylindrical insulator 608*a*. The discharge needle 608*b* is applied with a high voltage from a high voltage generator 610 through a high voltage cable 612.

Another conventional air-blow gun type of static eliminator is constructed so that a high voltage generator is disposed integrally with an gun body.

These conventional air-blow gun type of static eliminators are common in that a high voltage discharge electrode section is incorporated in the air-blow gun section or structure. For this reason, conventional air-blow gun type of static eliminator has a disadvantage described below.

(1) The air-blow gun uses a compressed air. The compressed air is carried up to the air-blow gun in which the air is expanded abruptly. Since the air is given adiabatic expansion and cooled, the generation of water droplets in the air-blow gun is inevitable. As shown in FIG. 44 which is a cross-sectional view of the electric section, that is, discharge electrode section of the air-blow gun type of static eliminator, the air-blow gun is always attended with the generation of droplets. The electric is leaked from the discharge needle 608*b* of high voltage electrode or the high voltage cable 612 via the water droplets. That is, electric leakage is generated. As a result, the operator working while carrying the air-blow gun by hand would be in danger from an electric shock or electrification.

FIG. 45 is a view for a model of an electric circuit showing the status of the electric leakage. In FIG. 45, the high voltage $V_0$ made in the high voltage generating circuit 622 is led to the discharge needle through a current limiting resistor R. Assuming that voltage drop across the current limiting resistor R is $V_D$, the discharge voltage is $V_1$, the discharge current is $I_1$, and the leak current is $I_2$.

$$V_1=V_0-V_D.$$

$$V_D=(I_1+I_2)R$$

Now, assuming that the high voltage $V_0$ is 5 KV, the current limiting resistor is 100 M ohms, and the discharge current is 1 microampere, and there is no leakage, that is, $I_2$ is 0, $$V_D=(1*10^{-6})*(100*106^{6})=100\ \text{V}.$$

and then the discharge needle voltage $(V_0-V_D)$=5 KV−100 V=4.9 KV.

On the other hand, assuming that there is a leakage and the leakage current is 50 microampere, $$V_D=(1*10^{-6}+50*10^{-6})*(100*10^{6})=5{,}100\ \text{V},$$

and then the discharge needle voltage=5 KV−5.1 KV nearly equals 0 KV.

The voltage at the discharge needle decreases due to the leakage and the discharging is caused to stop.

As mentioned above, when the leakage is generated due to the attachment of the water droplets to the high voltage section, the function of removing electricity is damaged and the electric shock accident would occur.

(2) The discharge needle incorporated in the air-blow gun readily becomes dirty and always must be cleaned. However, since the discharge needle is incorporated inside of the gun, the cleaning is difficult.

(3) The air-blow gun is a mechanical apparatus, and is made strongly enough to be resistant to the high pressure since the compressed air is used. Even if it is handled roughly, it is made strongly enough to be resistant to the water and oil. On the other hand, the static eliminator is a electric apparatus which must be electrically insulated completely to avoid the leakage since it is weak in moisture and the high voltage is used.

As mentioned above, the air-blow gun and the static eliminator themselves are quite different from each other in nature. However, they have been forced to be combined, and as a result there has been an inevitable problem of the leakage.

Another conventional static eliminator has a plus discharge needle and a minus discharge needle. These needles are disposed in parallel so as to issue plus ions and minus ions toward the object to be discharged. For miniaturization of the static eliminator, the distance between the pair of plus and minus discharge needles must be reduced. With the conventional static eliminator, the leading end of the discharge needle projects outwardly from its case, not shown.

With a still another conventional static eliminator, a pair of needles are disposed within the case. The conventional static eliminator prevents the operator from touching the needles inadvertently since the needles are applied with high voltage.

However, as the needles of the static eliminator are disposed adjacent to each other, the plus ions and minus ions generated are caused to be recombined immediately because of the pulling of each other by the coulomb force, and then the ions thus generated disappear. As a result, the electric power is wasteful and the quantity of ions which can be taken out effectively becomes short, and then its efficiency is decreased.

Furthermore, when the discharge needles are covered by the case, the ions which are not issued outside through the discharge apertures are confined in the case and the plus and minus ions are recombined. As a result, in a similar manner as mentioned above, the electric power is wasteful and the quantity of ions which can be taken out effectively becomes short, and then its efficiency is decreased.

Furthermore, conventional static eliminators take no consideration of the dust in the air, there is no static eliminator which has an air cleaning effect.

In the meanwhile, conventionally, as shown in FIG. 42, a main method of measuring static potential comprises positioning a measuring electrode 504 at a certain distance near from the object 500 to be measured, measuring electric field or electric force line from the object 500, and calculating back the static potential of the object 500. In this case, a static electric shelter 502 provided with opening is disposed in front of the measuring electrode 504, and the shelter 502 is mechanically or physically vibrated to measure an electric field. The measured value thus obtained by the measuring electrode 504 is amplified by an amplifier 506 and read by a meter 508. However, this measuring method uses a complicated structure, is weak in the vibration or shock and is expensive.

SUMMARY OF THE INVENTION

In view of the foregoing, it is an object of the invention to provide a wear-type of static electricity removing instrument, which can eliminate or remove static electricity accumulated on the operator walking around.

To accomplish the above-mentioned object, there is provided a wear-type of static eliminator which comprises a static eliminator body attachable to the human body, and a discharge section disposed within said remover body to issue ions toward the human body.

It is another object of the invention to provide a static eliminator which can remove static electricity from the human body and simultaneously remove static electricity from the work.

To accomplish the above-mentioned object, there is provided a portable static eliminator which comprises a remover body, said remover body including discharging means of issuing ions in two directions inside, said discharging means having two discharge needles, one disposed to be directed toward the human body and the other disposed to be directed toward a work.

It is a further object of the invention to provide a novel static potential measuring instrument.

It is a still further object of the invention to provide a static eliminator utilizing a priciple of a novel static potential measurement.

It is a still further object of the invention to provide a static eliminator having a static potential measuring function.

To accomplish these objects, there is provided a static potential measuring instrument which comprises a plus discharge needle for use in plus ion discharge, a minus discharge needle for use in minus ion discharge, a current source for generating a current supplied to said plus discharge and minus discharge needles, a plus current ammeter for measuring a current flowing from said current source to said plus discharge needle, a minus current ammeter for measuring a current flowing from said current source to said minus discharge needle, means of calculating the difference between absolute values of currents obtained by said ammeters, the ratio of one absolute value of current obtained by one of said ammeter to the other absolute value of current obtained by the other of said ammeter or both the difference and the ratio, and a measuring terminal connected to said current source.

There is also provided a static eliminator which comprises a plus discharge needle for use in plus ion discharge, a minus discharge needle for use in minus ion discharge, a current source for generating a current supplied to said plus discharge and minus discharge needles, and a connecting terminal connected to said current source.

There is also provided a static potential measuring instrument and static eliminator which comprises a plus discharge needle for use in plus ion discharge, a minus discharge needle for use in minus ion discharge, a current source for generating a current supplied to said plus discharge and minus discharge needles, a plus current ammeter for measuring a current flowing from said current source to said plus discharge needle, a minus current ammeter for measuring a current flowing from said current source to said minus discharge needle, means of calculating the difference between absolute values of currents obtained by said ammeters, the ratio of one absolute value of current obtained by one of said ammeter to the other absolute value of current obtained by the other of said ammeter or both the difference and the ratio, and a measuring terminal connected to said current source.

It is a still further object of the invention to provide an air-blow gun type of static eliminator which can prevent an electric leakage.

To accomplish the object, there is provided an air-blow gun type of static eliminator in which an electric system section having discharge needles for issuing ions and an air-blow gun system section having an air nozzle for ejecting air are configured so that they are independent electrically and machanically.

It is a still further object of the invention to provide a static eliminator which can prevent the rejoining of ions and eliminate useless power consumption.

To accomplish the object, there is provided a static eliminator which comprises a plus discharge needle, a minus discharge needle, and at least one partition wall provided between said discharge needles.

BRIEF DESCRIPTION OF THE DRAWINGS

The present invention will be now described in detail with reference to the preferred embodiments illustrated in the accompanying drawings in which:

FIG. 27 is a view showing the general positions of ion guns and an air gun when an ion stream is supplied in a tornado pattern.

DESCRIPTION OF THE PREFERRED EMBODIMENTS

Figure 1:
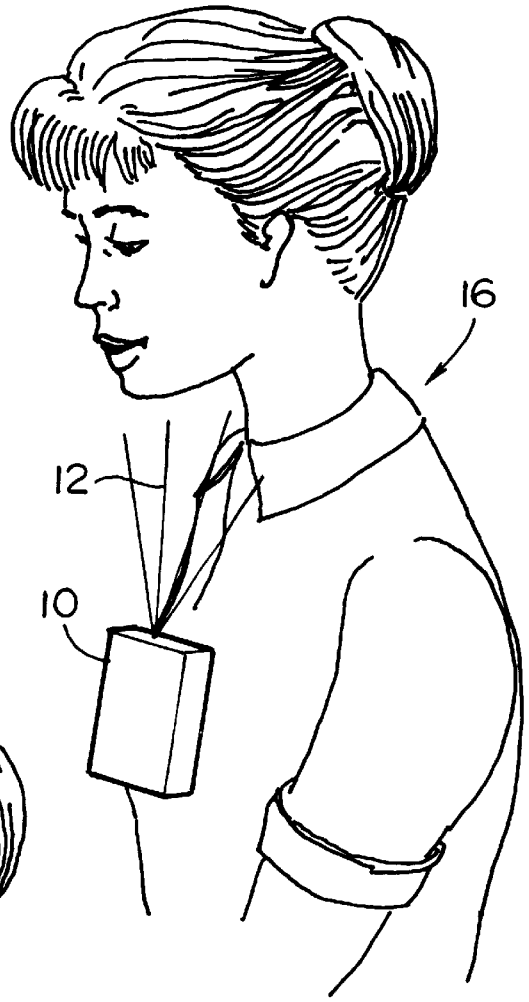
FIG. 1 is a diagrammatical perspective view showing an embodiment of wearing type of static eliminator according to the present invention.

In FIG. 1, a wear-type of or wearable electricity removing instrument or tool on, which an operator can wear on his chest is shown. The static eliminator 10 with ionizing function which an operator 16 wears on his chest and the ions generated by the static eliminator are adapted to be sprayed or issued on his face or neck. As a result, a static electricity charged on the operator body 16 is removed through his skin.

Figure 2:
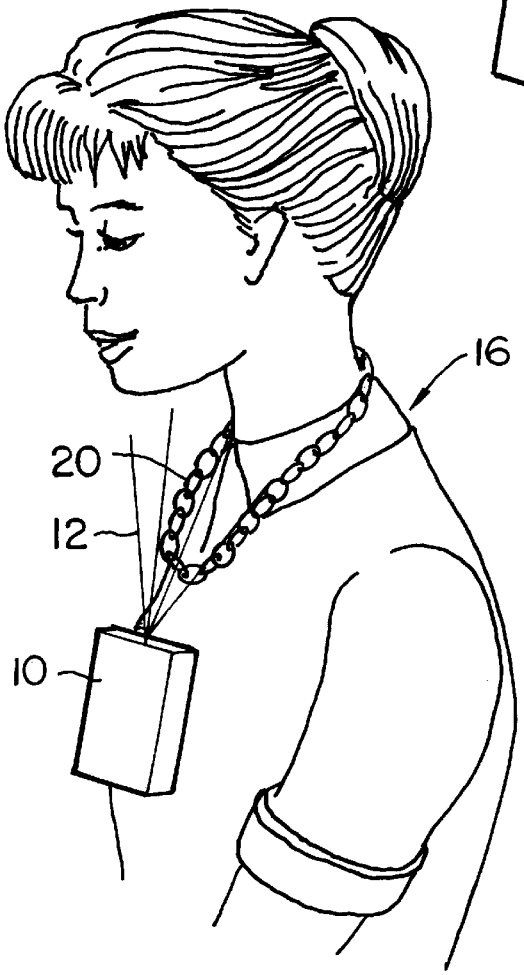
FIG. 2 is a diagrammatical perspective view showing another embodiment of wearing type of static eliminator.

With a modified embodiment shown in FIG. 2, the static eliminator 10 which the operator wears on his chest is adaped to spray ions on an electric conductor 20 such as a necklace which he wears. A static electricity charged or accumulated on the operator body 16 is removed or discharged through the electric conductor 20 to the air.

Figure 3:
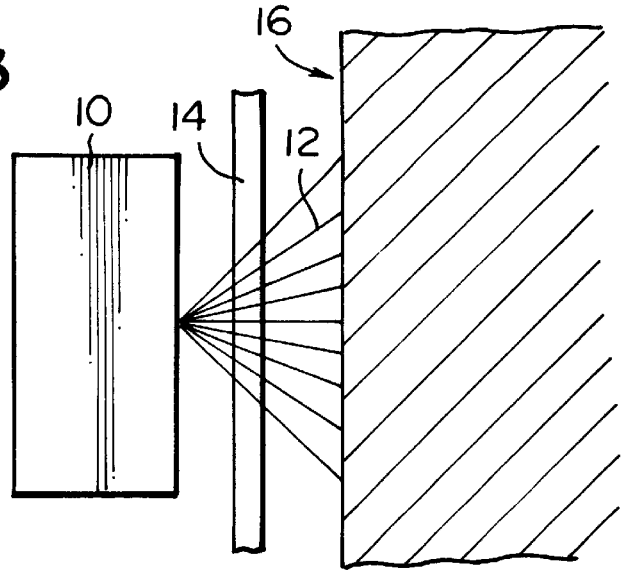
FIG. 3 is a diagrammatical perspective view showing a still another embodiment of wearing type of static eliminator.

FIG. 3 shows an embodiment in which the clothes are present between an operator body and an static eliminator. In this case, ions 12 go through the clothes 14 to the skin of the operator body 16 to remove an electricity therefrom. An experiment proved that the function of removing electricity was effective although it was less effective than that of no clothes.

Figure 4:
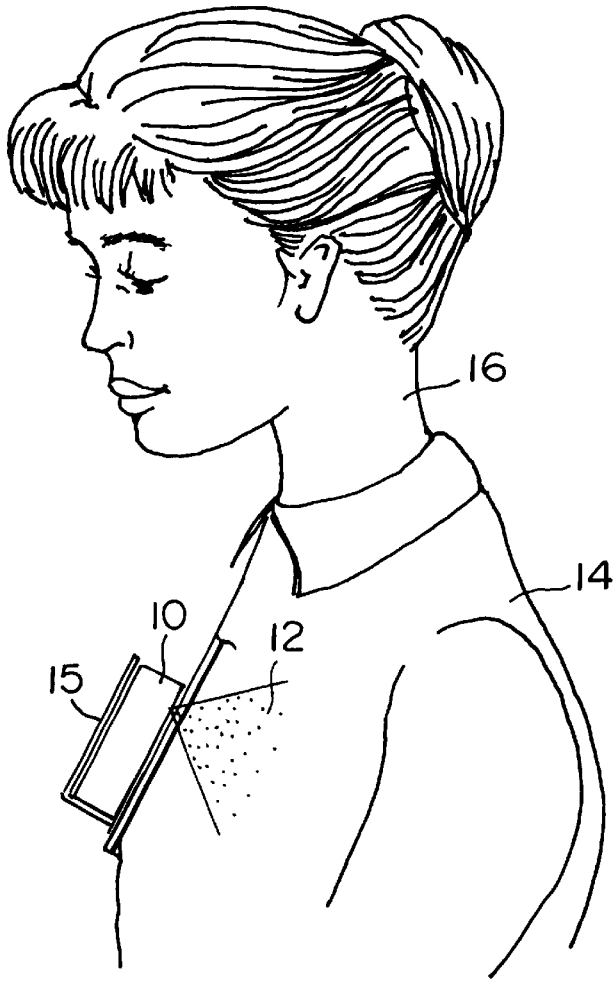
FIG. 4 is a diagrammatical perspective view showing a still another embodiment of wearing type of static eliminator.

FIG. 4 shows an embodiment in which a static eliminator is accommodated in the operator pocket and electricity is removed from the operator body. In the embodiment, the static eliminator 10 which is accommodated in the pocket 15 on the clothes 14 sprays ions through clothes 14 on the body 16.

Furthermore, the operator may wear the static eliminator on his hat. In such a case, ions may be adapted to reach the head skin through the hat cloth or an aperture formed in the hat. Furthermore, if a solar battery is provided on the static eliminator, an electric power is generated by the sun or the light from the electric lamp to operate the static eliminator.

Figure 5:
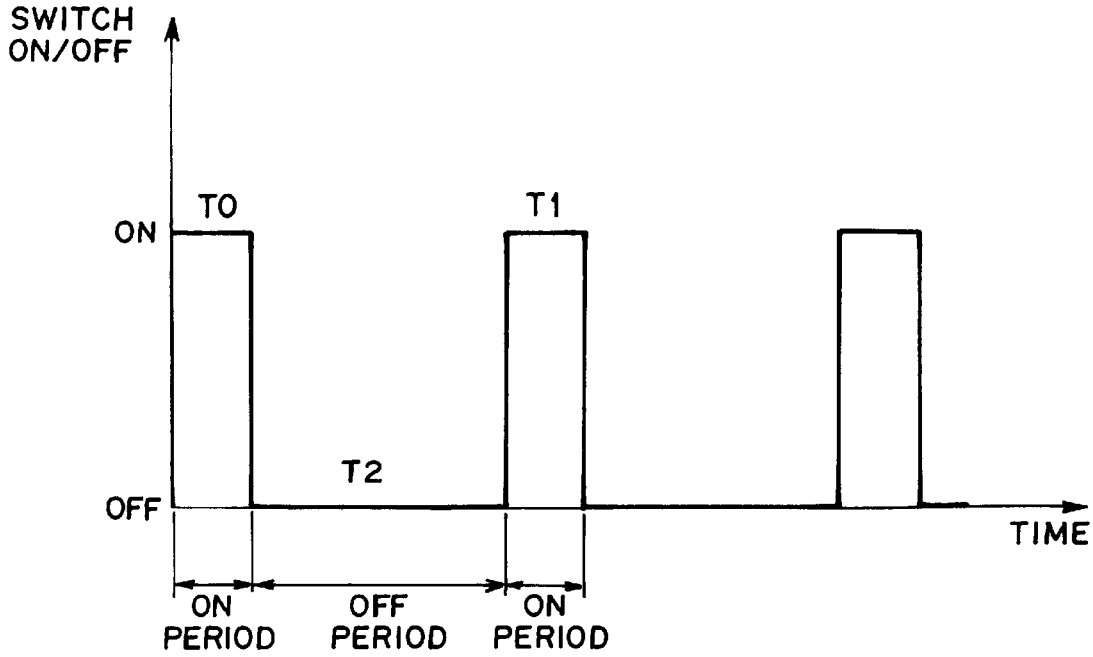
FIG. 5 is a gragh for explanation on an operation of the wearing type of static eliminator.

FIG. 5 is a view for explanation on a system for intermittently operating an static eliminator in accordance with the present invention. As shown in FIG. 5, the static eliminator is intermittently operated with a constant or fixed ON/OFF duty, or an adjustable ON/OFF duty. For example, when it is not necessary to spray ions always since electricity removing capacity is more than the generated electricity, the ratio of ON period to OFF period is set to be, for example, 1/6. On the other hand, when the static electricity is generated much more, the ratio of ON period to OFF period is set to be, for example, 3/7 to reduce the consumed electric power and the total quantity of generated ozone harmful to human bodies.

Figure 6:
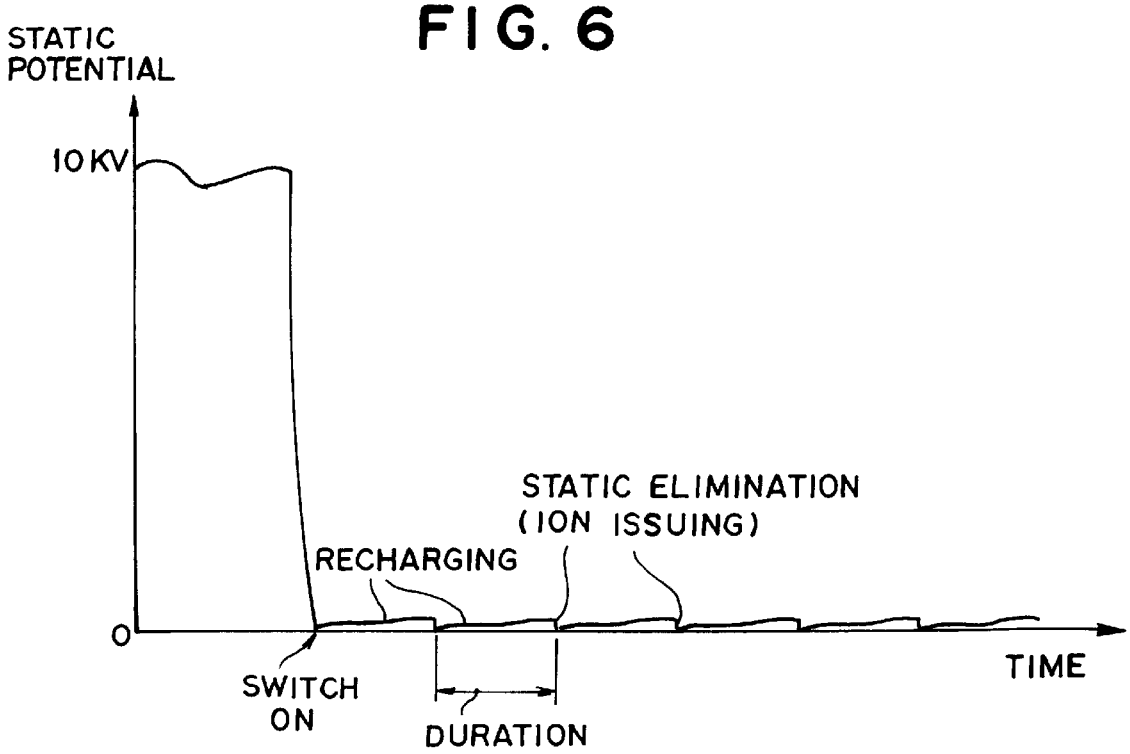
FIG. 6 is a gragh for explanation on an operation of the wearing type of static eliminator.

FIG. 6 is a view for explanation on a status of body's static electric potential when the intermittent operating system shown in FIG. 5 is used. In FIG. 6, first static potential of 10 KV charged on the body is reduced to an approximate 0V for 1 or 2 seconds, when the static eliminator is turned on. Then, when it is turned off, the static potential gradually goes up. After a predetermined period, for example, 10 second period, the static potential becomes, for example, 0.1 KV. At that time, the static eliminator is again turned on. Then, the stastic potential is again reduced to an approximate 0V.

Figure 7:
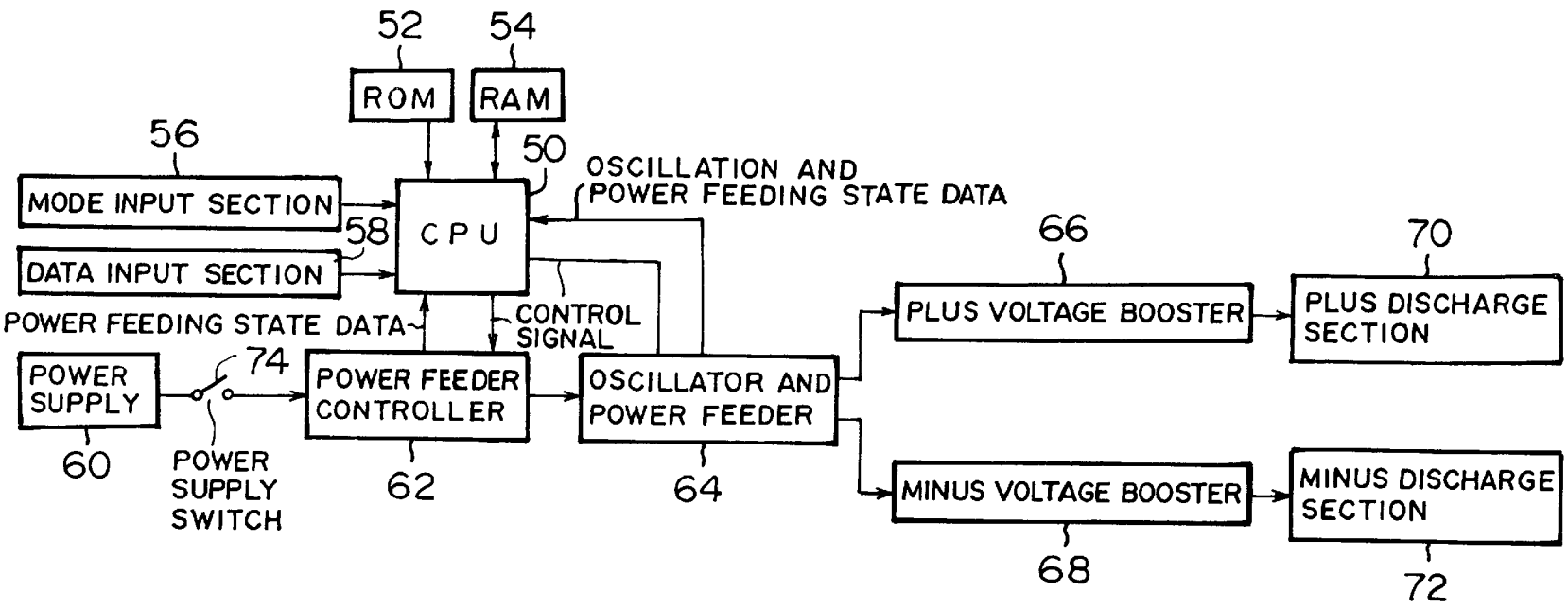
FIG. 7 is a block diagram showing a construction of the wearing type of static eliminator.

Referring now to FIG. 7, the configuration of the static eliminator according to the present invention will be explained. In FIG. 7, a CPU 50 controls a ROM 52, a RAM 54, a power feeder controller 62, an oscillator and power feeder 64. The CPU 50 receives mode information and data information, respectively, from mode inputting section 56 and data inputting section 58, and receives power supply state data from the power feeder controller 62 and transmits a control signal thereto, and receives oscillation data and power feeder state data from the oscillator and power feeder 64 and transmits control signal thereto.

The ROM 52 stores the program for controlling the CPU 50 and necessary initial data and the RAM 54 temporalily stores data used during operation. The mode inputting section 56 and data inputting. section 58 are, respectively, used to input necessary mode information and data information to the CPU 50. The power feeder controller 62 is supplied with an electric power through a power switch 74 from power source such as a battery, transmits the power feeder state data to the CPU 50, and supplies the oscillator and power feeder 64 with the electric power.

The oscillator and power feeder 64 switches on and off by its oscillator circuit a d. c. voltage which is received through the power switch 74 and the power feeder controller 62 to generate a boosted a. c. voltage, which appears on the secondary side of a transformer. A plus voltage booster 66 and a minus voltage booster 68, respectively, rectify and boost the a. c. voltage appearing on the secondary side of the transformer at the oscillator and power feeder 64 to a higher a. c. voltage enough to be discharged at a plus discharger 70 and a minus discharger 72. Furthermore, a multi-stage d. c. high voltage generating circuit is used as the circuit of the plus and minus voltage boosters 66 and 68.

Figure 8:
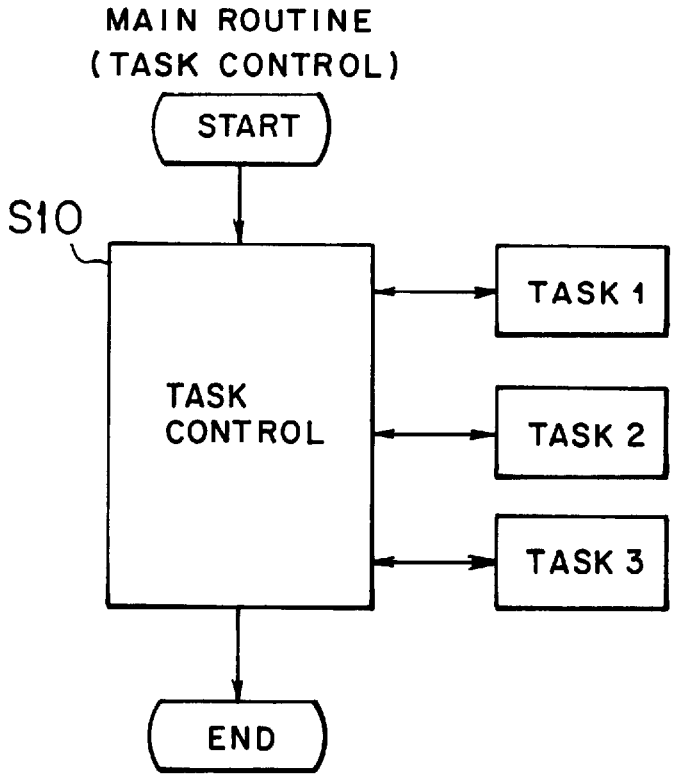
FIG. 8 is a flowchart for explanation on the operation of the wearing type of static eliminator.

Referring now to FIGS. 8–11 showing flow charts for operation of the static eliminator according to the present invention, an operation will be explained. As shown in FIG. 8, in a main routine or task control, the control on three task 1 through 3, hereinafter described in detail, is carried out (Step 10).

During operation, the task 2 or discharge control is mainly carried out. However, the task 1 or data input operation and the task 3 or power supply voltage check are simultaneously carried out.

Figure 9:
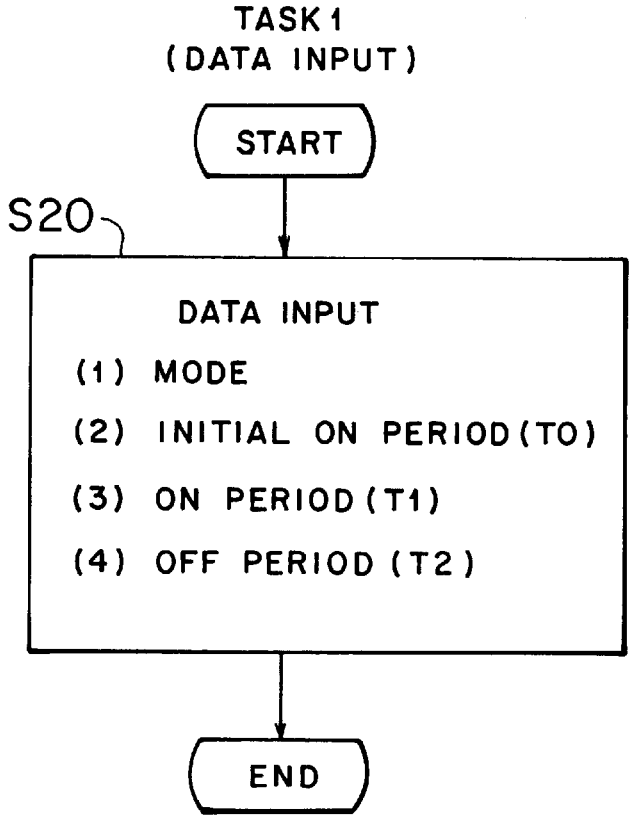
FIG. 9 is a flowchart for explanation on the operation of the wearing type of static eliminator.

As shown in FIG. 9, in the task 1 of data input operation, the data concerning mode, initial ON period (T0), ON period (T1), and OFF period (T2) are inputted (Step 20).

Figure 10:
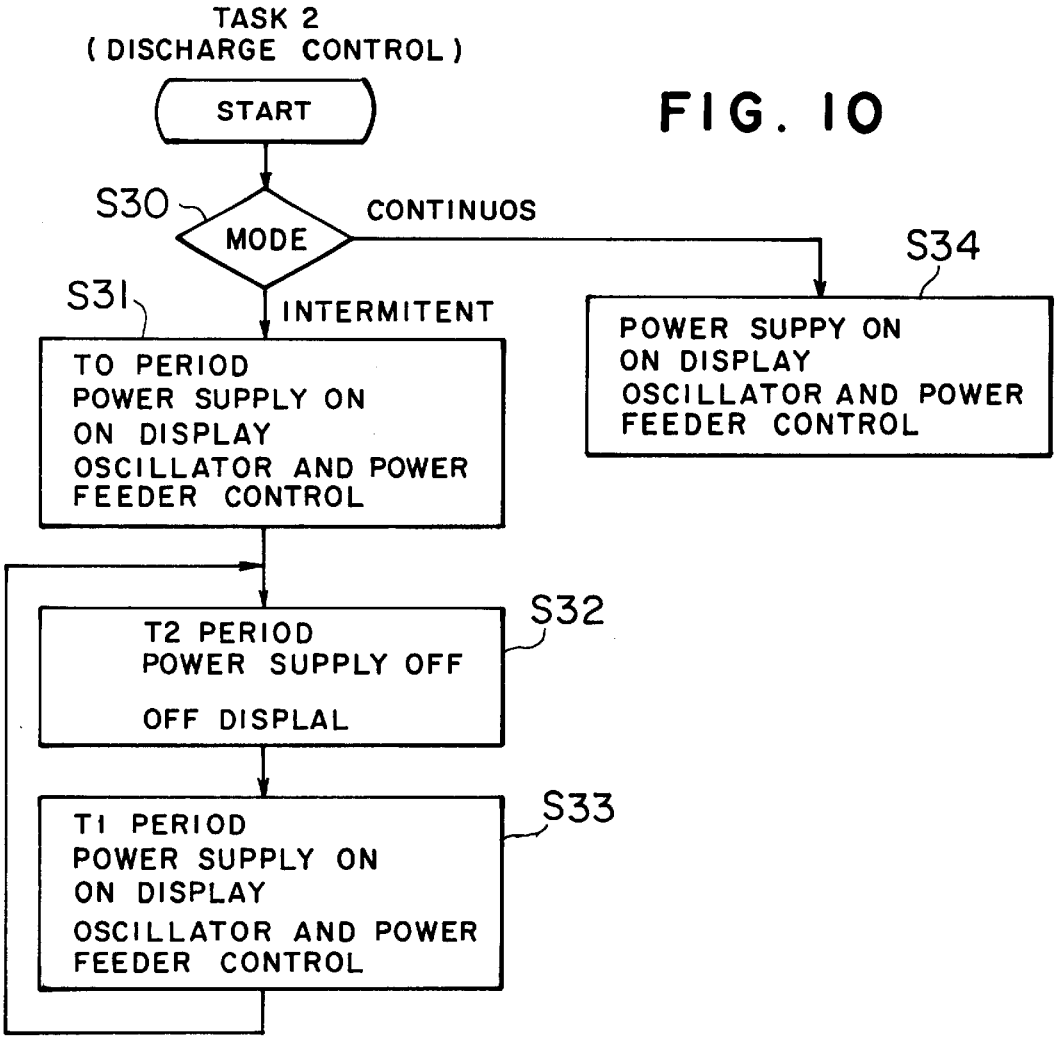
FIG. 10 is a flowchart for explanation on the operation of the wearing type of static eliminator.

As shown in FIG. 10, in the task 2 of discharge control, in the first place, the mode of discharge control indicated by the data inputted in the task 1 is judged as to whether the mode is an intermittent operation or a continuous operation (Step 30). Then; in case of intermittent mode, the power is supplied for the initial ON period (T0) indicated by the data inputted in the task 1 and an "ON" is displayed (Step 31). As a result, the plus and minus dischargers 70 and 72 are supplied with the power through the plus and minus voltage boosters 66 and 68 from the above-mentioned oscillator and power feeder 64, and thus plus and minus discharges are made.

Then, the power supply is stopped for the OFF period (T2) indicated by the data inputted in the task 1 and an "OFF" is displayed (Step 32). As a result, the discharge is interrupted for this OFF period.

Then, the power is supplied for the ON period (Ti) indicated by the data inputted in the task 1 and an "OFF" is displayed (Step 33). As a result, the plus and minus dischargers 70 and 72 are again supplied with the power through the plus and minus voltage boosters 66 and 68 from the above-mentioned oscillator and power feeder 64, and thus plus and minus discharges are made.

Thereafter, the Step 32 and the Step 33 are alternately repeated to make an intermittent discharge.

In the meanwhile, when the mode is judged as a continuous one at the Step 30, the power is continuously supplied and an "ON" is displayed (Step 34). As a result, the plus and minus dischargers 70 and 72 are supplied with the power through the plus and minus voltage boosters 66 and 68 from the above-mentioned oscillator and power feeder 64, and thus plus and minus discharges are continuously made.

Figure 11:
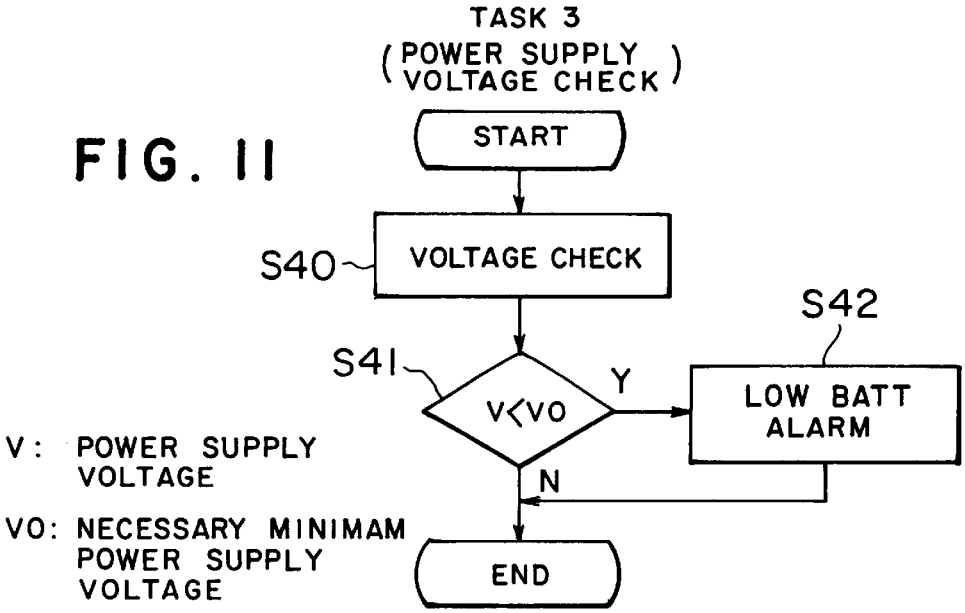
FIG. 11 is a flowchart for explanation on the operation of the wearing type of static eliminator.

As shown in FIG. 11, in the task 3 of the power supply voltage check, the voltage V of the power supply is checked as to whether the voltage V is lower than the necessary minimum voltage $V_0$ (Step 41). When it is lower, the alarm is issued (Step 42). In this case, in the main routine, the tasks 1 and 2 are controlled to be not active. On the other hand, when it is judged as being higher, the task 3 is ended, and the tasks 1 and 2 are controlled to be active.

Figure 12:
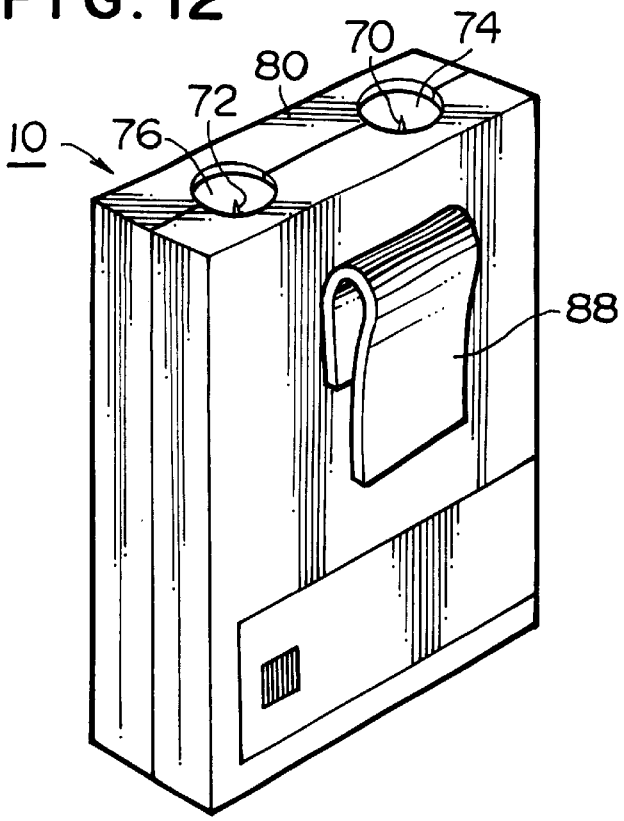
FIG. 12 is a perspective view showing a body of the wearing type of static eliminator.

Referring now to FIG. 12, the static eliminator itself will be explained. As shown in FIG. 12, the static eliminator 10 is provided with a body case 80, and on the rear side of body case 80, that is, on the operator side a clip 88 is provided. Means of attaching the body case to the operator is not limited to the clip, and any other member such as a conductive necklace as shown in FIG. 2 may be used.

The body case 80 is formed at its upper portion with two openings 74 and 76 for spraying ions therethrough onto the operator. The plus and minus dischargers 70 and 72 made of discharge needles are positioned approximately in the centers of these openings so as to be directed to the chest of the operator.

The function of static eliminator now will be explained. Now thinking of the discharge from the plus discharger, since the plus discharger is made to be an acute needle at its edge, a strong electric field is generated. As a result, the insulation breakdown of the air is caused to commence a corona discharge. In other words, plus ions are generated. The plus ions thus generated are repelled by the plus electric charge present on the needle to be diffused and sprayed away in the direction of the needle. Assuming that the operator is charged with the minus charges, the plus ions are attracted by the minus charges to be combined therewith and then neutralization is made, which results in the removal of static electricity from the operator. Furthermore, in case that the minus ions are directed to the operator, it is repelled by the minus electricity charged on the operator.

Furthermore, in case that the operator is charged with minus electricity, it is possible to remove static electricity by spraying minus ions on the operator. In the embodiment, both plus and minus dischargers are provided to be capable of removing stastic electricity whether the operator is charged with plus or minus electricity.

Figure 13:
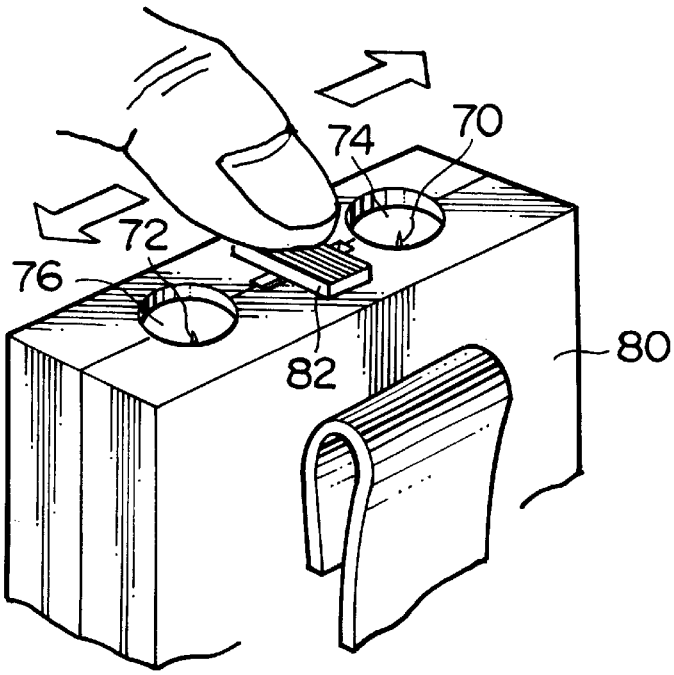
FIG. 13 is a partial perspective view showing a modified body of the wearing type of static eliminator.
Figure 14:
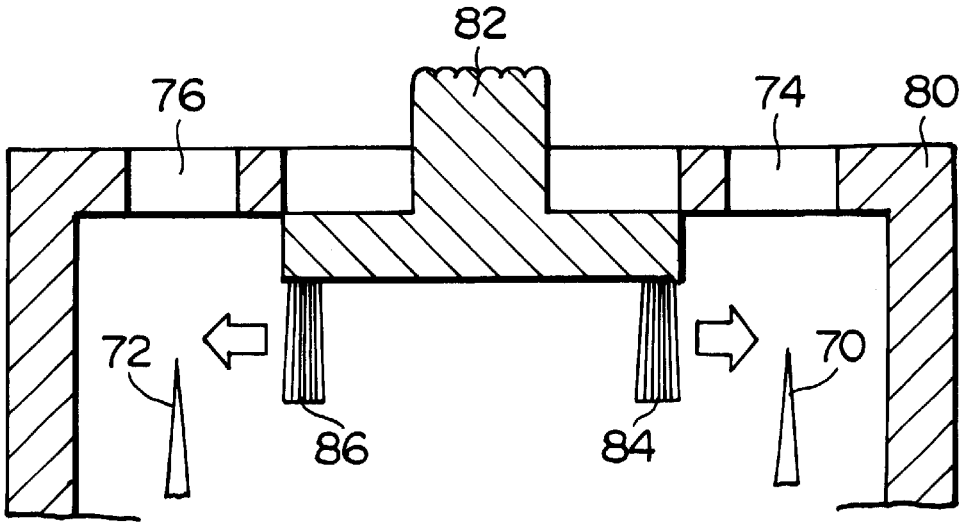
FIG. 14 is a partial cross sectional view showing another modified body of the wearing type of static eliminator.

FIGS. 13 and 14 show a modified embodiment of the static eliminator shown in FIG. 12. The dust in the air is readily attached to the discharge needles due to the corona discharge. Conventionally, a separate brush is used for cleaning. However, in the present invention, cleaning brushes are attached to the case body. As shown in FIG. 14, a knob 82 is slidably attached in the direction of arrows and is provided at ist lower portion with brushes 84 and 86. Therefore, when the knob 82 is slid in the direction of arrows, the brushes 84 and 86 cleans the needles 70 and 72 to be capable of removing the dust attached to the brushes. the cleaning brushes are effective particularly when the operator wears the static eliminator on his chest, since his breath reaches the discharge needles.

In general, when static electricity is removed, only either one of removement of electricity from the work or the operator body is conducted. However, when the operator touches the work in the state that static electricity is born on either one of them, the discharge is caused from ether one of them to the other. For this reason, it is preferable that the removement of electricity from both the work and the operator body is conducted. Conventionally, in order to do that, a plurality of static eliminator which are not portable are used to remove electricity from both the work and the operator body. However, since the operator would walk around, actually it is impossible to do so, which result in the static electricity accident.

Figure 15:
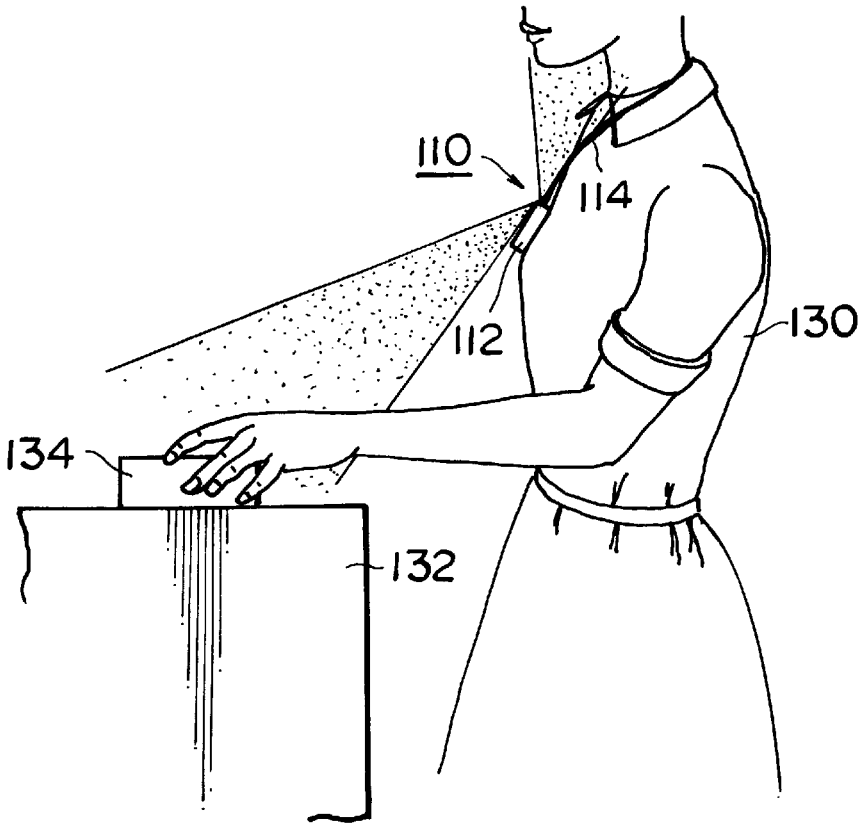
FIG. 15 is a view showing a status in use of an embodiment of static eliminator according to the present invention.

In order to solve the above-mentioned problem, in the embodiment, the remover according to the present invention is constructed so that a simultaneous removement of electricity from both the work and the operator body can be conducted. FIG. 15 shows the status of the manner in use of the static eliminator. A body 112 of an static eliminator 110 is hung on the operator body 130. The remover 110 removes electricity from an operator body 130 and simultaneously removes electricity from a work 134 on a table 132. Although described in detail later with reference to FIG. 16, a discharge needle for issuing or spraying ions toward the operator body and a discharge needle for issuing ions toward the work are provided inside of the remover body 112.

Figure 16:
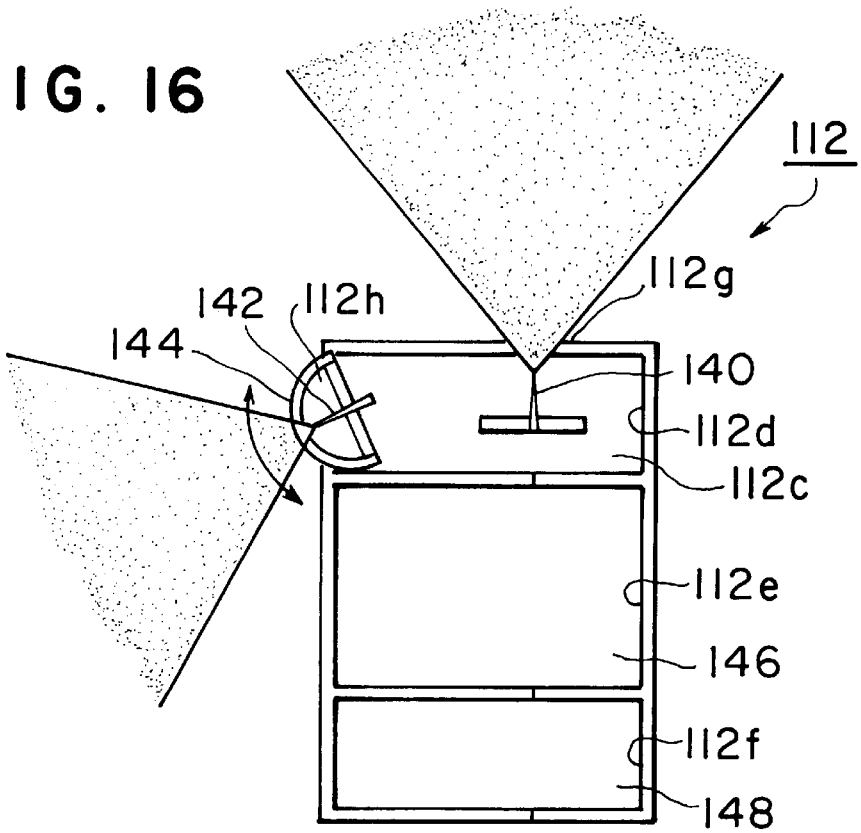
FIG. 16 is a cross sectional view showing an inner construction of the static eliminator.

As shown in FIG. 16, the remover body 112 includes a case 112*c*, and the case 112*c* is divided into three chambers 112*d*, 112*e* and 112*f* by partition walls. The chamber 112*d* is a discharge chamber in which two discharge needles 140 and 142 are disposed. The chamber 112*e* is for electronic circuit and accommodates an electronic circuit 146 therein, and the chamber 112*f* is for a battery and accommodates a battery 148 therein.

The discharge needle 140 disposed in the chamber 112*d* issues ions toward the operator body through a discharge aperture 112*g* formed in the case 112*c*. On the other hand, the discharge needle 142 issues ions toward the work through a discharge aperture 112*h* formed in the case 112. The needle 142 is attached to a rotor 144 to alter its direction within a predetermined angular region. Thus, the discharge needle 142 covers the work disposed in a relatively large area. The rotation of the rotor 144 is made by a motor, not shown, continuously or intermittently, and may be made manually. Furthermore, the dischage needle 140 may be constructed so that it is also rotatable.

Figure 17:
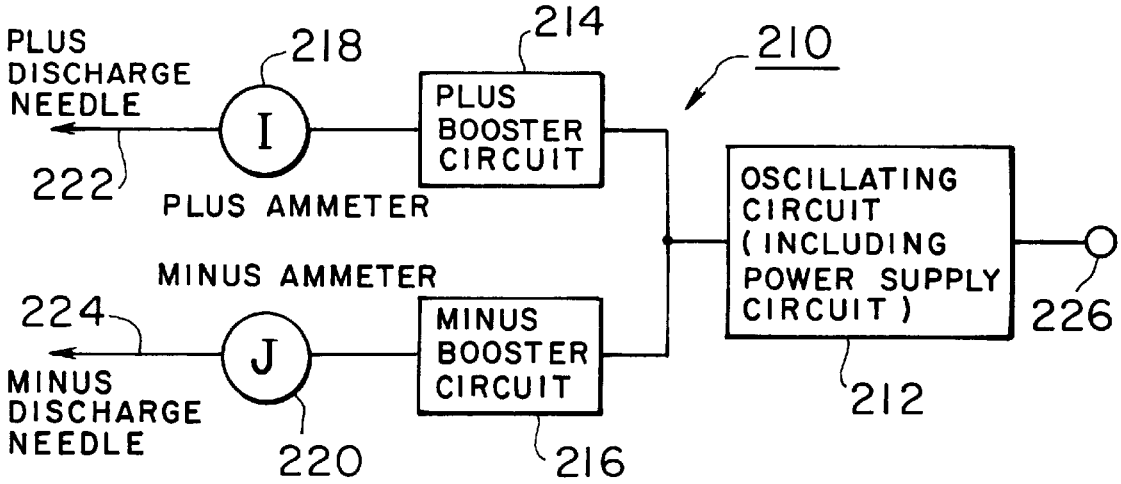
FIG. 17 is a block circuit showing a main portion of an embodiment of a static potential measuring instrument according to the present invention.
Figure 18:
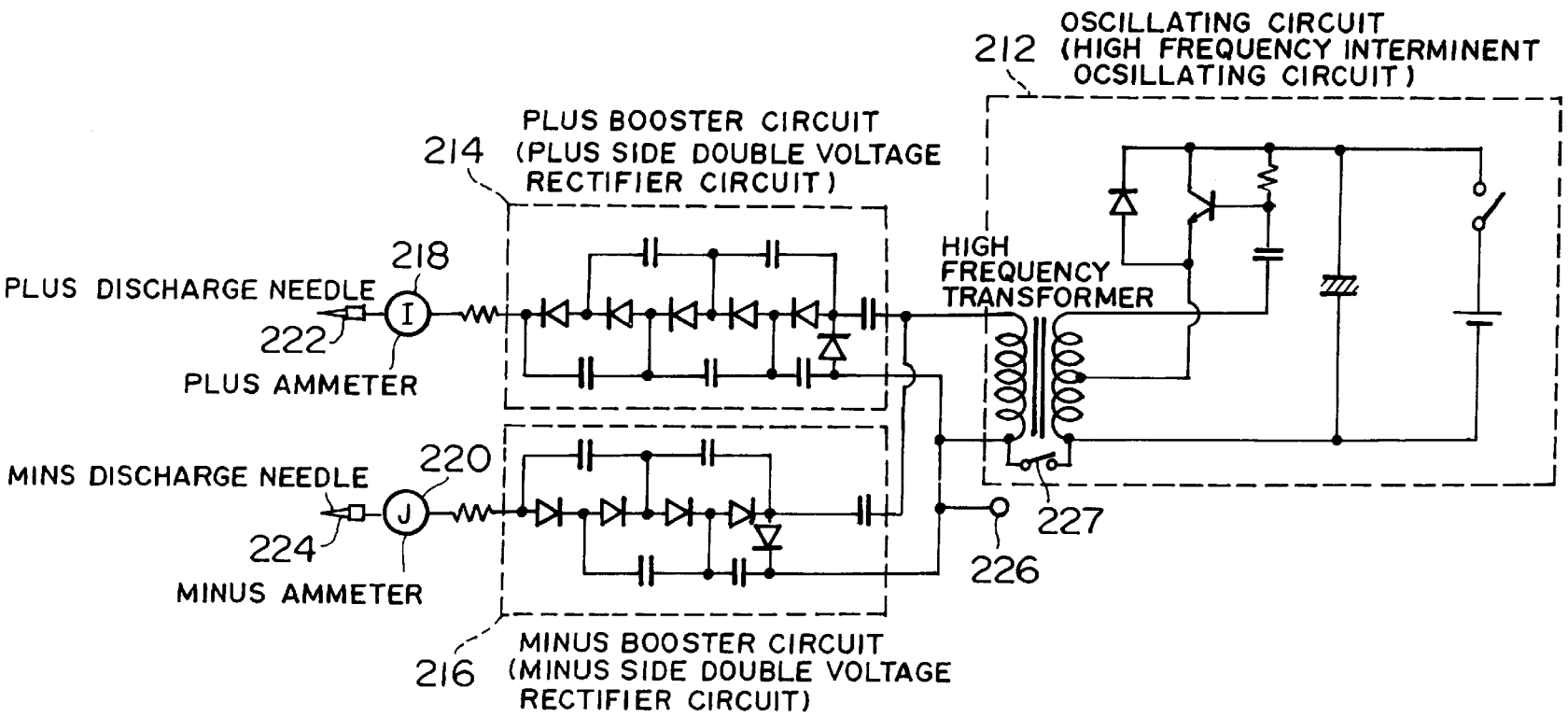
FIG. 18 is a view showing an electronic circuit of the static potential measuring instrument.

FIG. 17 is a block diagram showing a main portion of a static potential measuring instrument according to the present invention. FIG. 18 is a circuit of static measuring instrument according to the present invention. As shown in FIG. 17, a measuring instrument 210 includes a oscillating circuit 212, a plus booster circuit 214, a minus booster circuit 216, a plus discharge needle 222, a minus discharge needle 224 and a measuring terminal 226. This construction for measurement is the same as that of the static eliminator. However, in the present invention, in addition to the construction of the static eliminator, there are provided sensors, that is, ammeters 218 and 220 for measuring a plus discharge current and a minus discharge current. Thus, the measuring instrument according to the present invention also has an electricity removing function.

The measurement of static potential is made as follows. A plus high current and a minus high current are measured and the static potential at the measuring terminal 226 is obtained by calculation from the difference between the absolute values of the measured values, or the ratio of those absolute values, or from both the difference and the ratio.

In FIG. 18, the circuit on the side of the secondary winding of oscillating transformer, which is a high frequency booster transformer, included in the oscillating circuit 212 is insulated from the circuit on the side of primary winding since the primary and secondary windings are insulated from each other. Thus, even if the primary circuit is connected to the outside power supply line, the secondary circuit is insulated from the earth. Therefore, when a quantity of plus ions issued from the plus discharge needle differs from a quantity of minus ions issued from the minus discharge needle, the circuit on the side of the secondary winding changes its static potential to make the quantities of discharged plus and minus ions to be equal. For example, the static potential becomes minus, the quantity of the discharged plus ions becomes more to reduce the static potential. Then, when the static potential becomes low, the quantity of the discharged plus ions is reduced. Consequently, the quantity of the discharged plus ions and the quantity of the discharged minus ions become equal. In other words, the ion balance, that is, the balance between the plus ions and minus ions generated is adjusted. This is a basic principle of the static electricity measuring instrument and is effective to adjust the balance between the discharged plus and minus ions. Furthermore, a switch 227 is disposed between the primary and secondary windings of the high frequency booster transformer to connect these windings or to disconnect one from the other.

Figure 19:
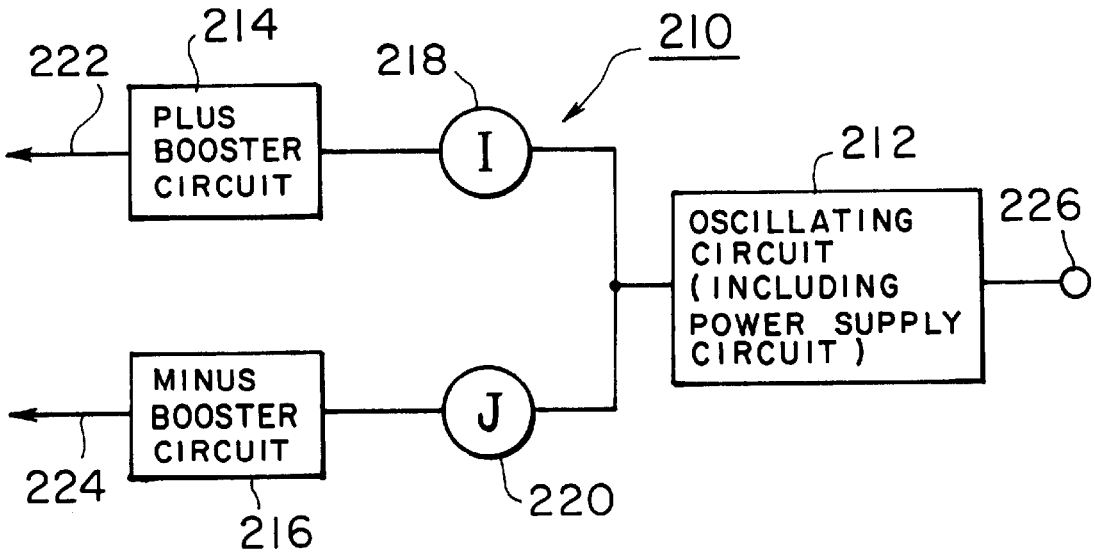
FIG. 19 is a block circuit showing a main portion of another embodiment of a static potential measuring instrument.

FIG. 19 is a circuit block showing a main portion of a static potential measuring instrument in other embodiment. Since, as described in the embodiment shown in FIG. 17, the measurement of the currents is conducted by measuring the currents at the high voltage section after boosted, the measurement is relatively difficult. In such a case, in this static potential measuring instrument, the measurement of the current is made before the double voltage rectification, that is, before the boosting.

Figure 20:
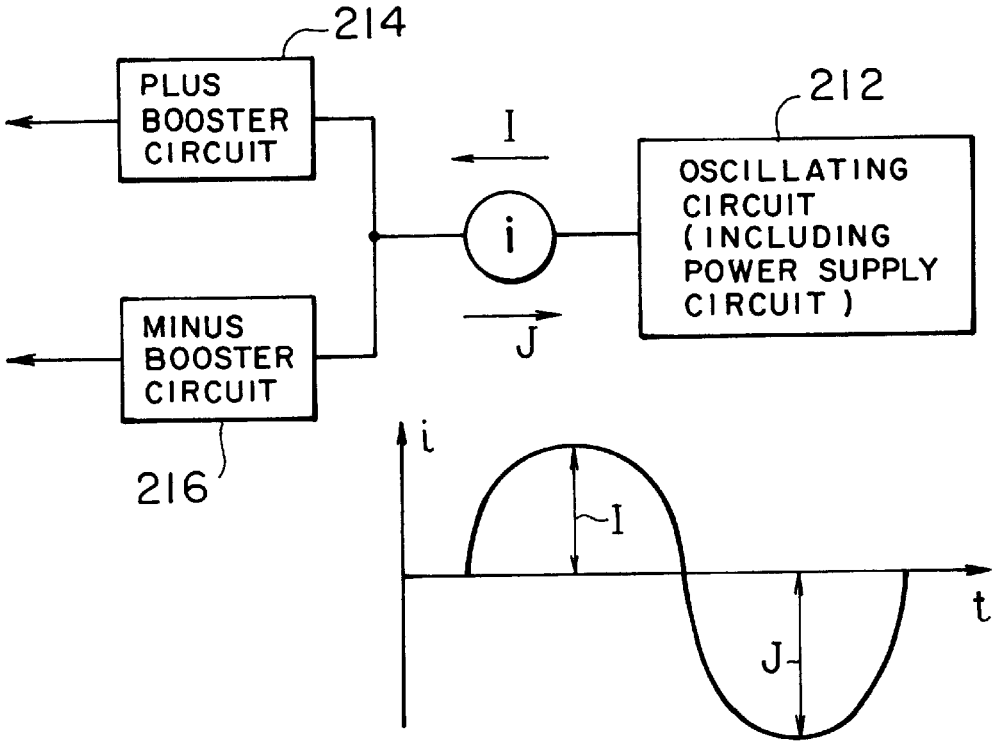
FIG. 20 is a block circuit showing a main portion of a still another embodiment of a static potential measuring instrument.

FIG. 20 is a block circuit showing a main portion of a static potential measuring instrument in a still other embodiment. As described in the embodiment as shown in FIG. 19, two d. c. ammeters are required, since the measurement of current is made at the two positions on the plus and minus sides. On the other hand, in the circuit shown in FIG. 20, only one a. c. ammeter is disposed between the junction of the plus booster circuit 214 and the minus booster circuit 216 and the output terminal of oscillating circuit 212 to measure a plus current I and a minus current J. As shown in the gragh of FIG. 20, the value I of the plus current which flows out from the oscillating circuit 212 in the plus booster circuit 214 is measured during a positive half cycle and then the value J of the minus current which flows in the oscillating circuit 212 from the minus booster circuit 216 is measured during a next negative half cycle. Then, the approximate values of plus and minus discharge currents are obtained.

Figure 21:
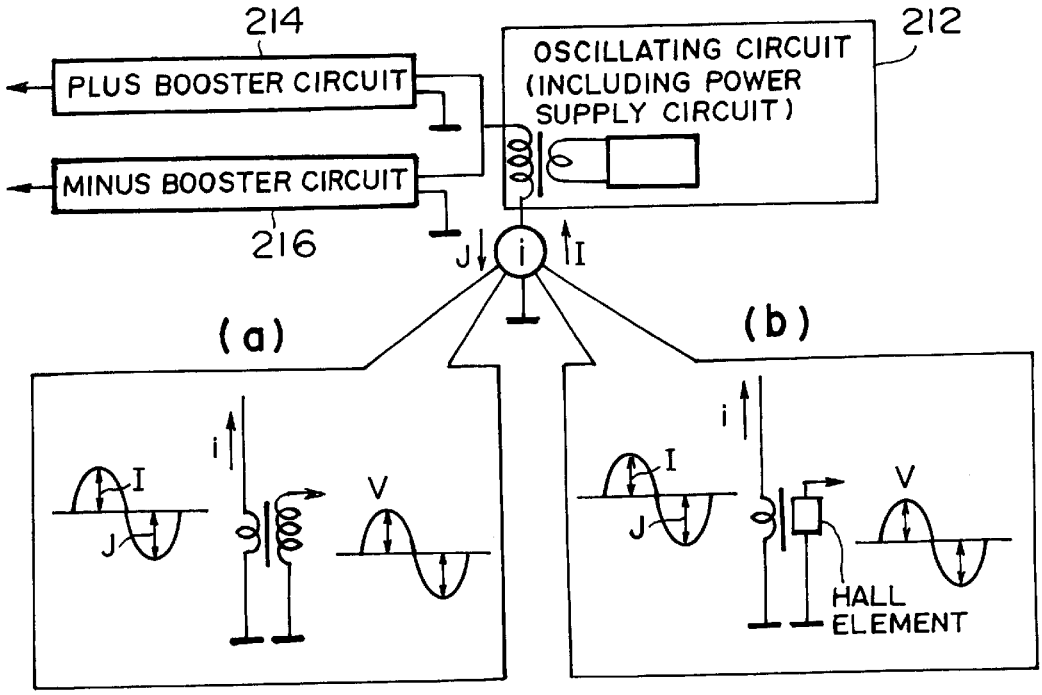
FIG. 21 is a block circuit showing a main portion of a still another embodiment of a static potential measuring instrument.

FIG. 21 is a block circuit showing a main portion of a static potential measuring instrument in a still other embodiment. Since as described in the embodiment shown in FIG. 20, the measurement of the current is made downstream of the output terminal of the oscillating circuit, the measurement is made downstream of the high frequency booster transformer, clear from FIG. 18, where the voltage becomes high a little bit, and in fact the voltage is boosted to an approximate 1 kilovolt. Therefore, the measurement is troublesome and high in cost. On the other hand, since in the embodiment in FIG. 21 the measurement is carried out in the position where the voltage is low, it is easily made and low in cost.

In FIG. 21, an ammeter is disposed at the high frequency transformer, more particularly, between the terminal on the ground side of the secondary winding and the earth or the ground to measure the current. Since, at that point, the voltage is almost 0 V, the measurement can be easily made. Specific methods for measurement are drawn enlargedly in FIG. 21*a* and 21*b*. In FIG. 21*a*, the change in d. c. current i are converted into the change in voltage v (and amplified ) by a transformer and then the voltage thus obtained is measured. In FIG. 21*b*, the current i is transduced into magnetic strength by a coil and the magnetic strength is detected by a Hall element to measure it as the voltage. Although the coil for current measurement is disposed in series with the high frequency booster transformer as shown in FIGS. 21*a* and 21*b*, there is no problem unless the impedance of the coil is high.

A principle of measurement of static potential at the measuring terminal of the static potential measuring instrument will be explained about three cases with reference to FIG. 22.

Case 1:

Assuming that the potential at the measuring terminal of the static potential measuring instrument is 0V. At that time, the absolute value, indicated at I (1), of the current discharged from the plus high voltage electrode, that is,. the plus discharge needle and the absolute value, indicated at J (1), of the current discharged from the minus high voltage electrode are approximately equal, that is, I (1)−J (1)=0.

Case 2:

Assuming that the potential at the measuring terminal of the static potential measuring instrument is +3 KV. At that time, the plus high voltage electrode becomes +8 KV (5 KV+3 KV), and the absolute value, indicated at I (2), of the current discharged from the plus high voltage electrode is big. On the other hand, the minus high voltage electrode becomes −2 KV (−5 KV+3 KV), and the absolute value, indicated at J (2), of the current discharged from the minus high voltage electrode is small. That is, I (2)−J (2)>0.

Case 3:

Assuming that the potential at the measuring terminal of the static potential measuring instrument is −4 KV. At that time, the plus high voltage electrode becomes +1 KV (5 KV−3 KV), and the absolute value, indicated at I (3), of the current discharged from the plus high voltage electrode is small. On the other hand, the minus high voltage electrode becomes −2 KV (−5 KV−4 KV), and the absolute value, indicated at J (3), of the current discharged from the minus high voltage electrode is big. That is, I (3)−J (3)<0.

Thus, the difference of the absolute values (I−J) of the discharge currents from the plus and minus electorodes changes its magnitude and sign, depending on potentials charged on the static potential measuring instrument itself. In other words, the potential charged on the measuring terminal of the static potential measuring instrument is a function of (I−J), and its charged potential can be indicated by F(I−J). Furthermore, instead of the difference (I−J), the ratio (I/J ) or both the difference and the ratio can be used when the static potential is measured. The foregoing is a principle of measurement of static potential according to the present invention.

Figure 23:
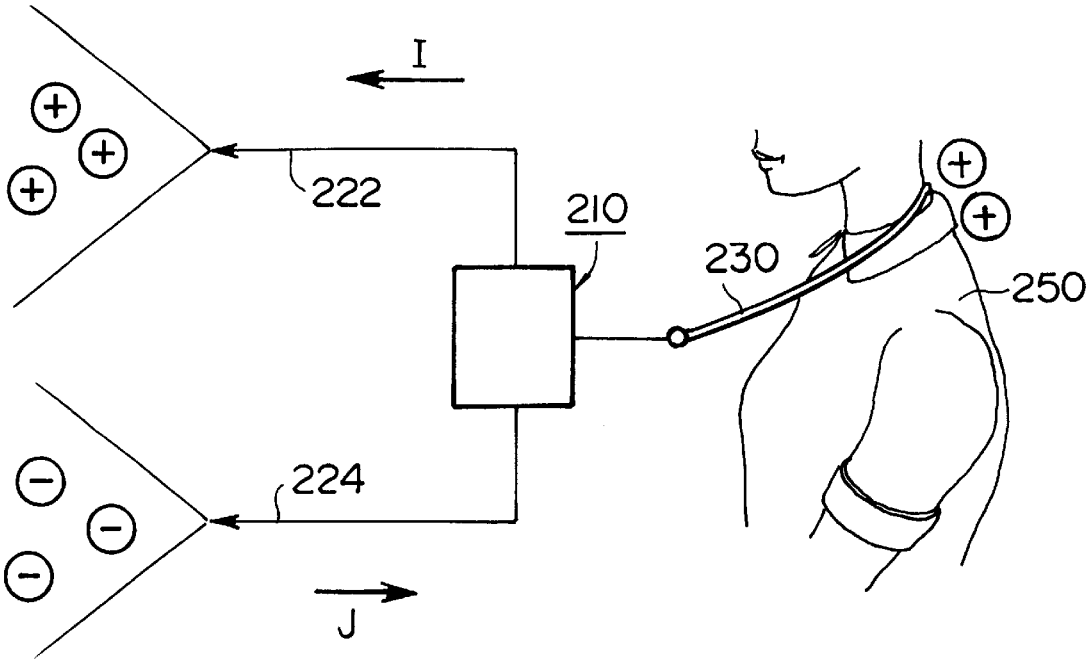
FIG. 23 is a view for explanation on a principle of static eliminator for human body.

Referring now to FIG. 23 showing a principle of removing electricity from the human body, a human body 250 and an static eliminator 210 are electrically connected by an electric conductor 230 and the static eliminator is operated so as to issue ions. At that time, when the human body bears plus charges or is charged positively, I is bigger than J, as shown in FIG. 19, and then plus charges accumulated on the human body 250 is discharged. Thus, the charges on the human body are removed as the static eliminator discharges ions. This is one type of principle of the human body static eliminator.

Figure 22:
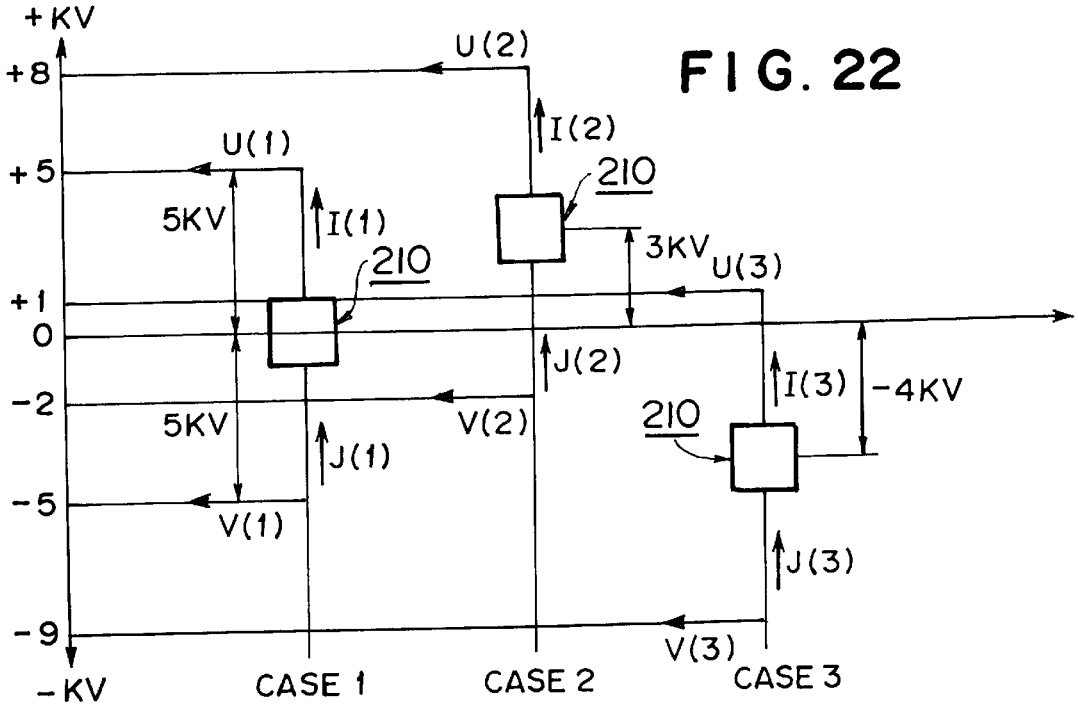
FIG. 22 is a view for explanation for explanation on a principle of the measurement of static potential at the measuring terminal by the static potential measuring instrument.

When the principles explained with reference to FIGS. 22 and 23 are combined together, a composite function instrument, that is, a static eliminator having a static potential measuring function in which a static eliminator according to the present invention and a static potential measuring instrument according to the present invention are formed integrally. The composite function instrument is shown in FIG. 24.

Figure 24:
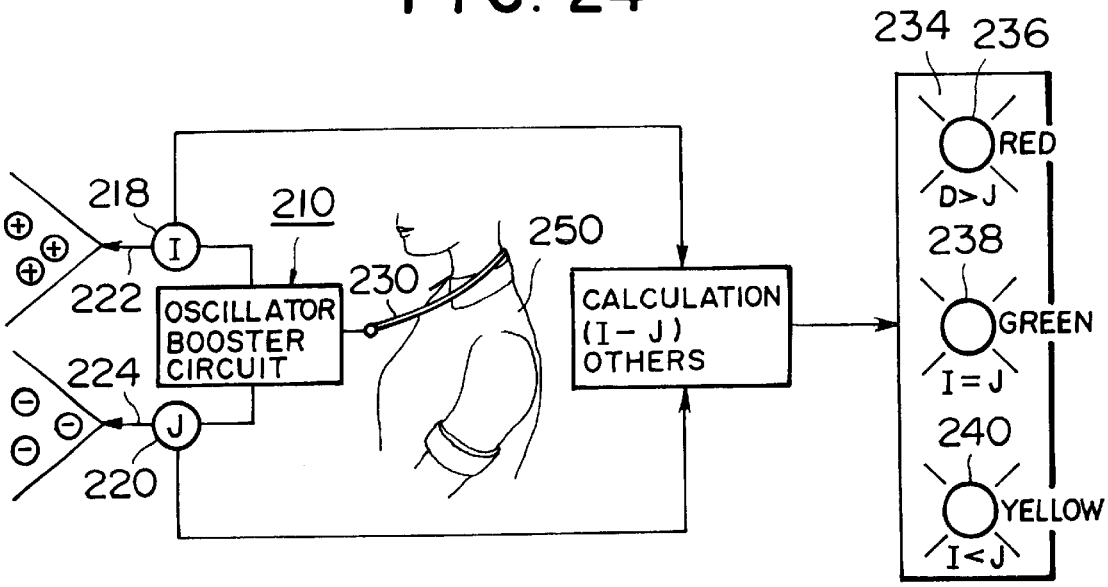
FIG. 24 is a view showing a compositely functioning instrument in which an static eliminator and a static electricity measuring instrument are integrally formed, that is, a static eliminator having a static electricity measuring function.

In FIG. 24, an electricity is removed from the human body by discharging electricity from the plus and minus discharge electrodes 222 and 224 of the static eliminator 210 electrically connected to the human body 250. Simultaneously, the plus and minus discharged currents are measured by the current sensors 218 and 220, and (I−J) or (I/J ) or a combination thereof are calculated by the arithmetic section 232. The potential charged on the human body is obtained from the polarity and magnitude, and then the resultant thus obtained is displayed on the displaying device 234 such as a meter or a monitor to indicate the level on which static electricity is accumulated on the human body. For example, when plus electricity is charged (I>J), a red lamp 236 in the displaying device is turned on. When no electricity is charged (I=J), a green lamp 238 is turned on. Then, when minus electricity is charged, a yellow lamp 240 is turned on.

The composite function instrument according to the present invention measures a static potential and at the same time removes electricity to reduce the static potential to 0 volt. When the human body bears electric charges due to any cause, the state is displayed. When the static eliminator normally operates, the static potential immediately returns to 0 volt. Furthermore, when the static eliminator does not work due to any trouble or when the generation of static electricity is more than electricity removing capacity, the charged state is displayed to let the operator know it.

Figure 25:
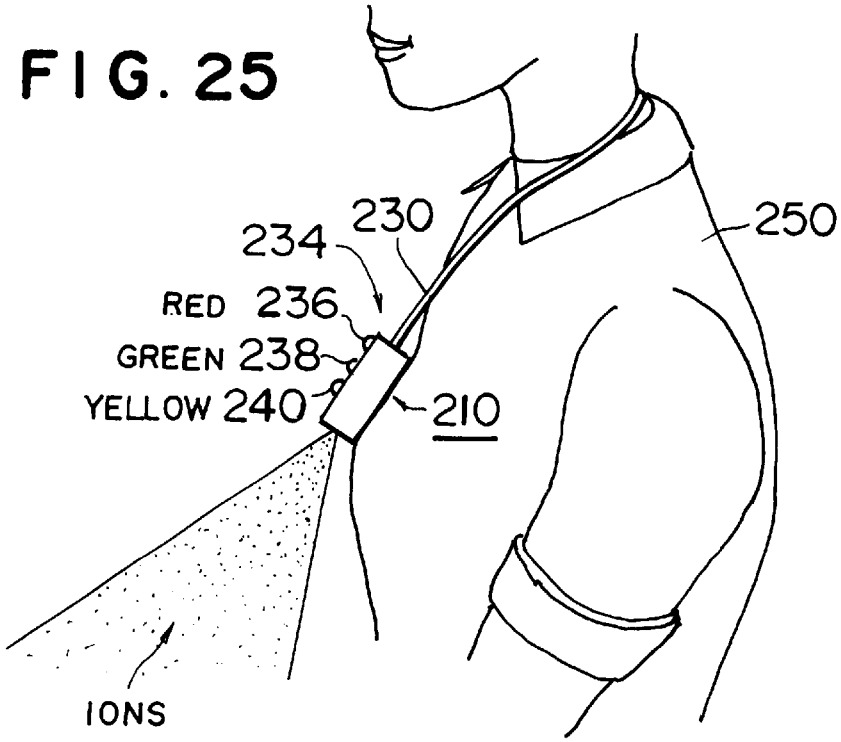
FIG. 25 is a view showing an actual embodiment of the static eliminator.

FIG. 25 shows an actual embodiment. As shown in FIG. 25, the static eliminator 210 is hung from the human body 250 by its conductive strap 230 and therefore is electrically connected to the human body. The ions are issued toward the body portion except face or neck where the skin of the human body is exposed. The body of the static eliminator 210 is provided with a display 234 which is a monitor for displaying static electricity. When no electricity is charged, a green lamp 238 is turned on to indicate a sign as safety. When positive electricity is charged, a red lamp 236 is turned on to indicate a sign as abnormality. When negative electricity is charged, a yellow lamp 240 is turned on to indicate a sign as abnormality.

Figure 26:
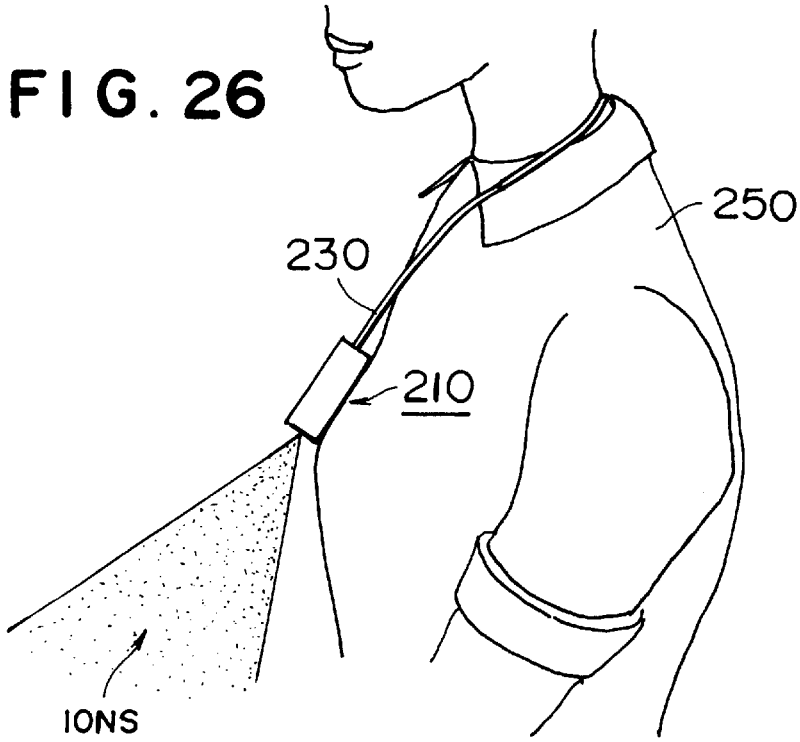
FIG. 26 is a view showing another embodiment of the static eliminator.

FIG. 26 shows another embodiment. Although in the embodiment shown in FIG. 25, one of the color lamps is turned on in response to whether the static electric is present or not, this embodiment is directed to the function of removing electricity. The static eliminator 210 has a circuit similar to that explained with reference to FIGS. 17 to 21, and removes electricity from the human body on the principle similar to that explained with reference to the FIG. 23. Thus, in the embodiment, static potential is not measured.

Figure 27:
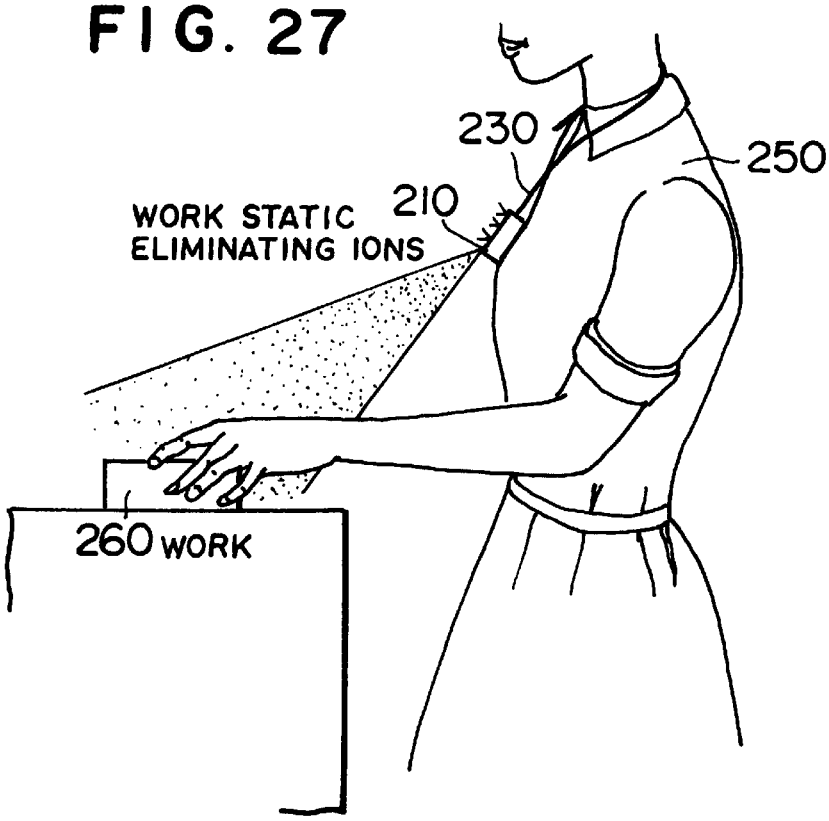
FIG. 27 is a view showing a still another embodiment of the static eliminator.

FIG. 27 shows a still another embodiment. Although in the embodiment shown in FIG. 25, the ions are not directed to a particular object, the measurement of the static potential and the removement of electricity accumulated on the human body are made by merely discharging, in the embodiment as shown in FIG. 27, the ions are issued toward the work to be discharged and removes electricity from the work, in addition to the measurement of the static potential and the removement of electricity. As mentioned above, the embodiment fulfills the three functions of (1) the removement of electricity from the human body, (2) the removement of electricity from the work and (3) the measurement and the display of the static potential on the human body.

To summarize, the static eliminator in accordance with the present invention can accomplish the above-mentioned three functions required in the field regardless of a mere construction of static eliminator. That is, a very economical and effective remover can be obtained.

Figure 28:
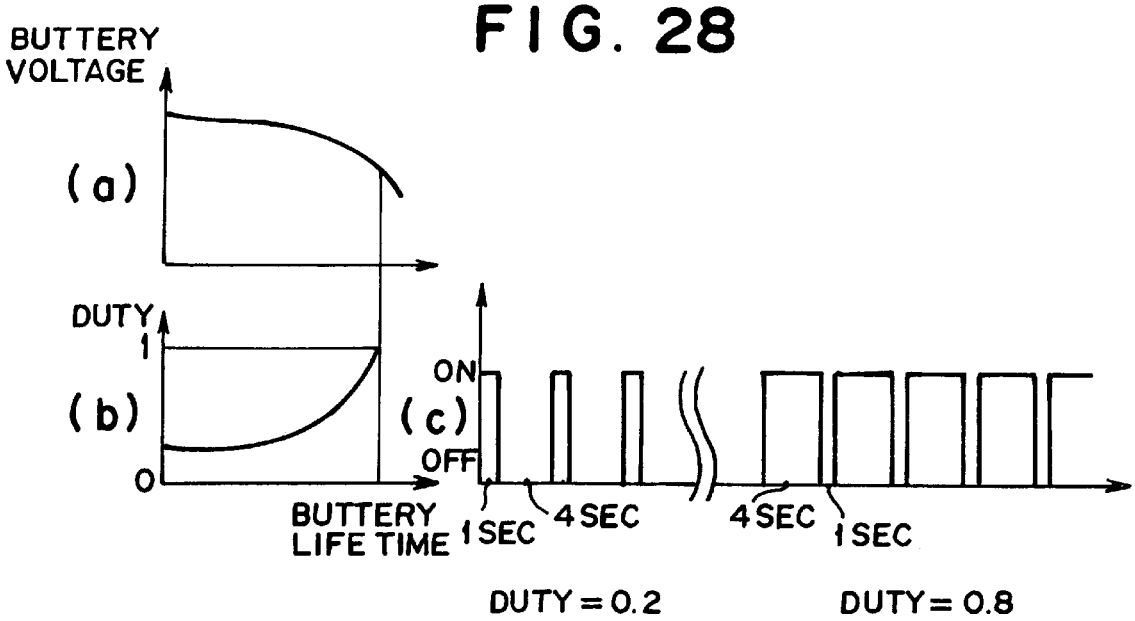
FIG. 28 is a view for explanation on a method of suppressing variation of voltage of power supply of static eliminator.

FIG. 28 is a view for explanation on a method of suppressing a fluctuation in voltage at the power supply of the static eliminator. The fluctuation in voltage at the power supply is large mainly for a portable battery-driven static eliminator. FIG. 28*a* shows a property of voltage drop at the battery. As shown in FIG. 28*a*, the voltage drops with time. Even in such a case, in order to maintain the capacity of static eliminator to be constant, the period of issuing ions is controlled as shown in FIGS. 28*b* and 28*c*. That is, when the voltage at the battery is high sufficiently, the period of issuing ions is limited to a fraction of time, that is, the duty ratio is maintained to be small. As the voltage at the battery becomes low, the duty ratio is caused to be bigger. In this manner, the electricity removing capacity is always maintained to be constant.

The air-blow gun in accordance with the present invention is constructed so that its electric system section and air-blow gun system section are completely independent of each other. When they are combined; the ions issued from the discharge needle provided within the electric system section and the compressed air issued from the air nozzle provided within the air-blow gun system section are effected by each other.

In order to understand the advantages derived from the fact that the static eliminator in accordance with the present invention comprises an electric system section or structure and an air-blow gun system section or structure completely independent from each other, the explanation on properties which the electric system section and the air-blow gun system section usually has will be made.

(1) Life Time:

The life time of the electric system section depends on the life time of the electronic parts and is approximately 5 to 7 years, and the life time of the air-blow gun system is approximately 1 or 2 years although it depends on the manner of use. since, as mentioned above, they greatly differ in their life times, the air-blow gun system section which is short in life time may be exchanged earlier.

(2) Congeniality to Water:

The electric system section is not congenial to water very much due to the use of high voltage. When the water intrudes into the electric system section, at first the electric leakage occurs, and then the electrification would occur. Further, the discharging is stopped due to the electric leakage or becomes weak and as a result the effect of removing electricity is reduced. On the other hand, the air-blow gun system section is resistant to water and oil as well as contamination. Since, as mentioned above, the electric system section and the air-blow gun system section have inherent disadvantages, respectively, when these are integrally constructed conventionally, individual disadvantage cannot be compensated sufficiently.

Figure 29A:
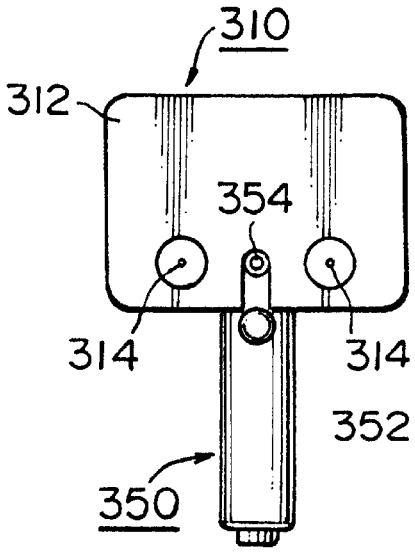
FIG. 29 is a view showing a status that an electric system and a gun system of an air gun type of an static eliminator according to the present invention are combined.
Figure 29B:
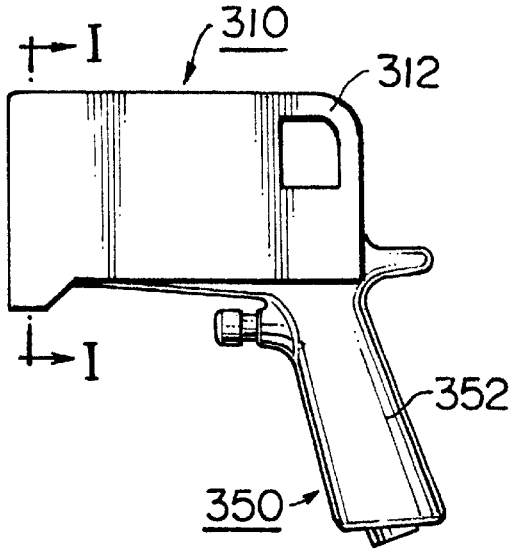
Figure 30A:
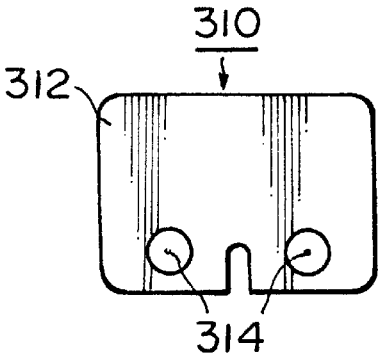
FIG. 30 is a view showing a status before an electric system and a gun system of an air gun type of an static eliminator according to the present invention are combined.
Figure 30B:
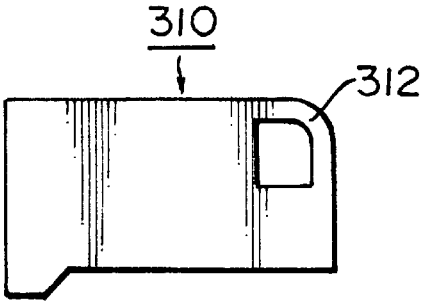
Figure 30C:
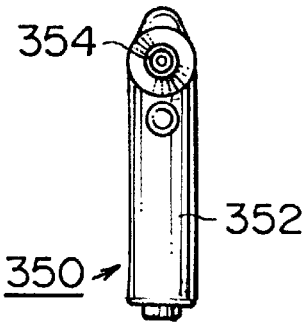
Figure 30D:
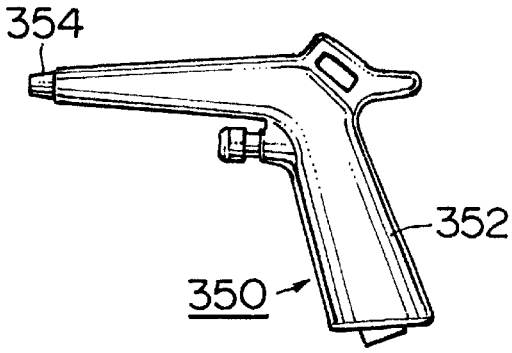

Now, the combination of the electric system section and gun system section according to the present invention will be explained. FIG. 29 shows the state that the electric system section and the air-blow gun of the air-blow gun type static eliminator according to the present invention are combined, and in FIG. 29, FIG. 29*a* is a front view thereof and FIG. 29*b* is a side view thereof. FIG. 30 shows the state before the electric system section and the air-blow gun of the air-blow gun type static eliminator according to the present invention are combined,and in FIG. 30, FIG. 30*a* is a front view thereof and FIG. 30*b* is a side view thereof.

As shown in FIGS. 29 and 30, the electric system section 310 includes a body 310 and discharge needles 314, 314, which are left and right needles in this embodiment, provided on the body at its leading end. On the other hand, the gun system section 350 includes a body 352 and an air nozzle 354 provided on the body at its leading end. The body 312 of the electric system section 310 is constructed so that the body 312 is detachable to the body 352 of the gun system section 350. The lower portion of the body 312 of the electric system section is formed so as to be complementary to the shape of the upper portion of the body 352 so that the body 312 properly seats on the the body 352. The complementary shape is omitted for clarification of the drawings.

Since the electric system section and the gun system section are constructed as mentioned above, the electric system section 310 and the gun system section 350 are separated from each other in electric and water relationship. However, the they are detachable in construction.

Figure 31:
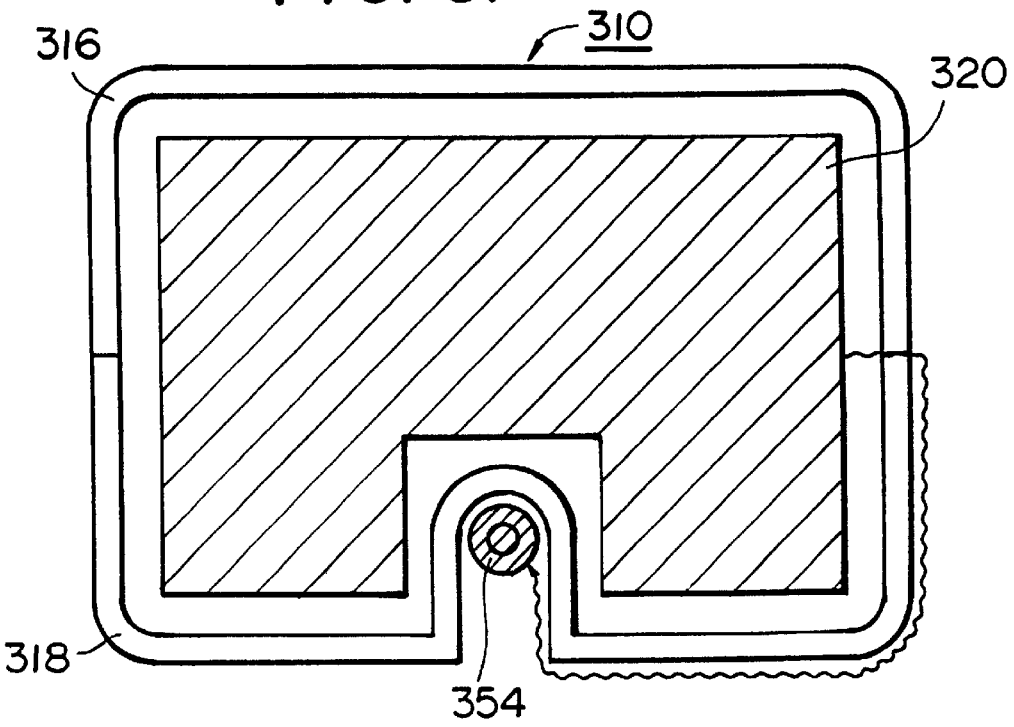
FIG. 31 is a diagrammatically cross-sectional view along line A—A of FIG. 29.

Referring now to FIG. 31, the insulating construction of the electric system section will be explained. FIG. 31 is a cross-sectional view along line A—A of the FIG. 29. In the state that the electric system section 310 and the gun system section 350 are combined, the discharge or electric leakage between the high voltage section 320 of the electric system section 310 where the metal member generally occupies and the metal air nozzle 354 is considered.

As shown in FIG. 31, in the present invention, a case for insulating a high voltage 320 from an air nozzle 354 is formed of an upper cabinet 316 and a lower cabinet 318 and thus the seam between cabinets is located at the opposite sides of the case. This construction is such that the discharge or leakage is hard to be generated since the discharge is generated through the seas of the insulator, and there is a large distance between the air nozzle 354 of the gun system section 350 and the seam portion.

Now, the two power supplying systems at the conventional static eliminator will be explained. There are an a. c. static eliminator and a d. c. static eliminator. The a. d. static eliminator supplies an a. c. high voltage to one discharge needle to issue plus ions and minus ions alternately. On the other hand, the d. c. static eliminator supplies a plus voltage and a minus voltage to a pair of discharge needles to be capable of issuing plus and minus ions in good mixed state.

Figure 32A:
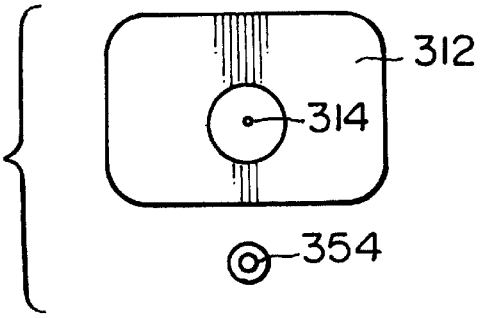
FIG. 32 is an end view of an a. c. static eliminator according to the present invention.
Figure 32B:
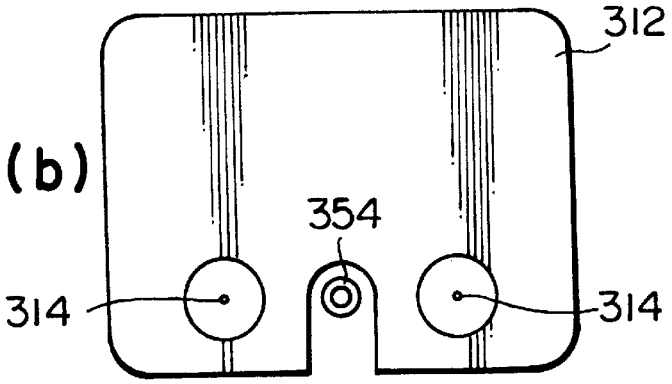

The static eliminator according to the present invention is effective in the aforementioned two systems, and will be explained below. FIG. 32 is an end view showing a d. c. static eliminator, and in FIG. 32, FIG. 32*a* is an end view showing the static eliminator using one discharge needle, and FIG. 32*b* is an end view showing the static eliminator using two discharge needles. The discharge needle or needles 314 and air nozzle 354 are disposed so that the electric system section and gun system section are separated and insulated from each other and, ions and air can be supplied in good mixed state.

Figure 33A:
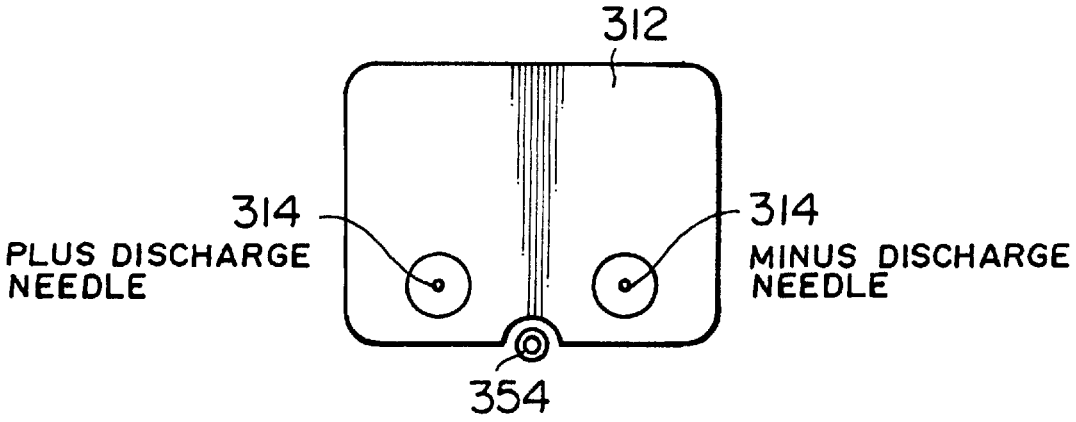
FIG. 33 is an end view of a d. c. static eliminator according to the present invention.
Figure 33B:
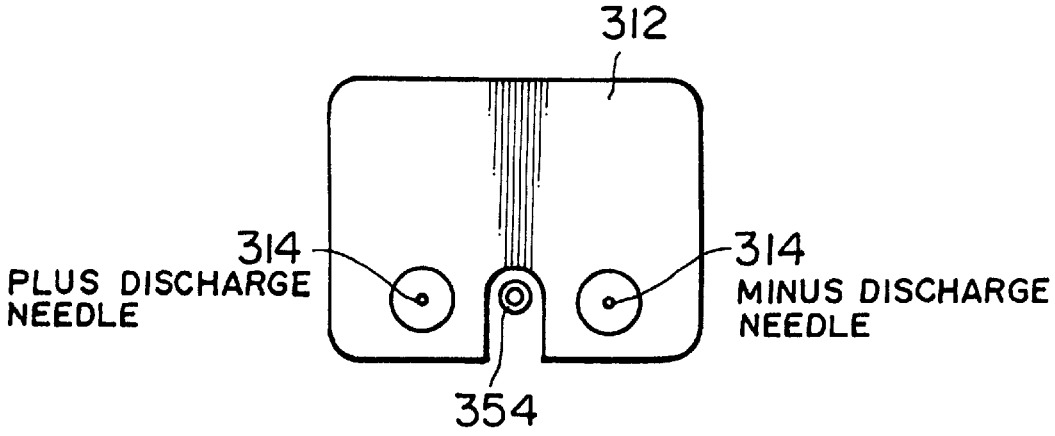
Figure 33C:
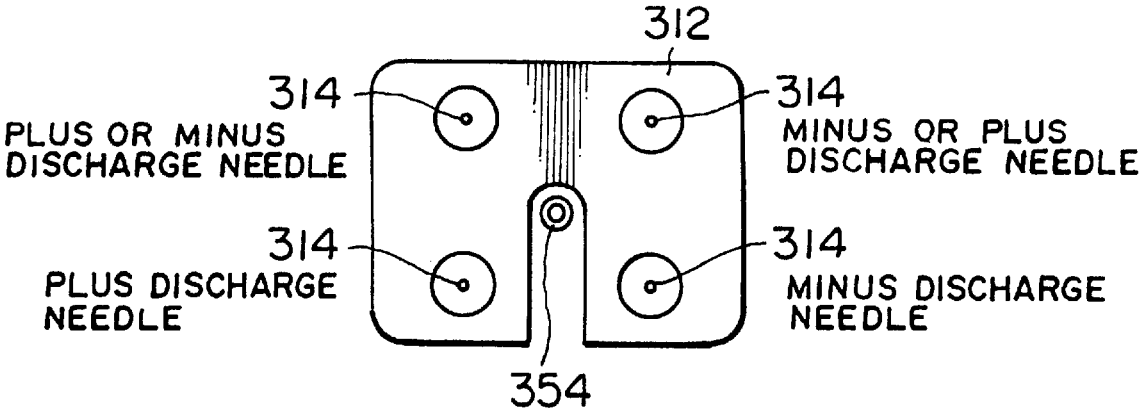

FIG. 33 is an end view showing a d. c. static eliminator according to the present invention, and in FIG. 33, FIG. 33*a* is an end view showing that a pair of discharge needle and an air nozzle are adjacently disposed, FIG. 33*b* is an end view showing that an air nozzle is disposed between a pair of discharge needles, FIG. 33*c* is an end view showing that an air nozzle disposed among two discharge needles.

In FIGS. 33*a* to 33*c*, the air nozzle 354 are disposed adjacent the pair of discharge needles 314, 314, see FIG. 33*a*, air nozzle 354 is disposed between the pair of discharge needle 314, 314, see FIG. 33*b*, or the air nozzle 354 is disposed among the two pair of discharge needles 314, 314, 314 and 314. In the case shown in FIG. 33*c*, the right and left needles can be of opposite polarity, or the upper and lower needles can be of opposite polarity.

In the aforementioned construction, the electric system section and gun system section are separated and insulated from each other and, ions and air can be supplied in good mixed state.

Figure 34:
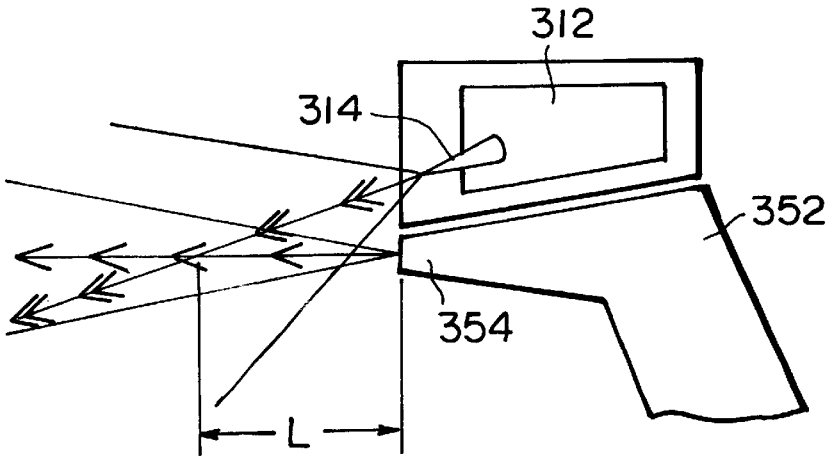
FIG. 34 is a side view for explanation on the mixture of an air stream and an ion stream.

FIG. 34 shows a method wherein an discharge needle or needles are declined toward the direction in that air is issued to mix the stream of air and the stream of ions well. The discharge needle 314 is disposed to be declined toward the air nozzle so that, at the cross point L in front of the leading end of the air nozzle 354 of the gun system section, the stream of air and the centerline of stream of the ion are crossed.

Figure 35:
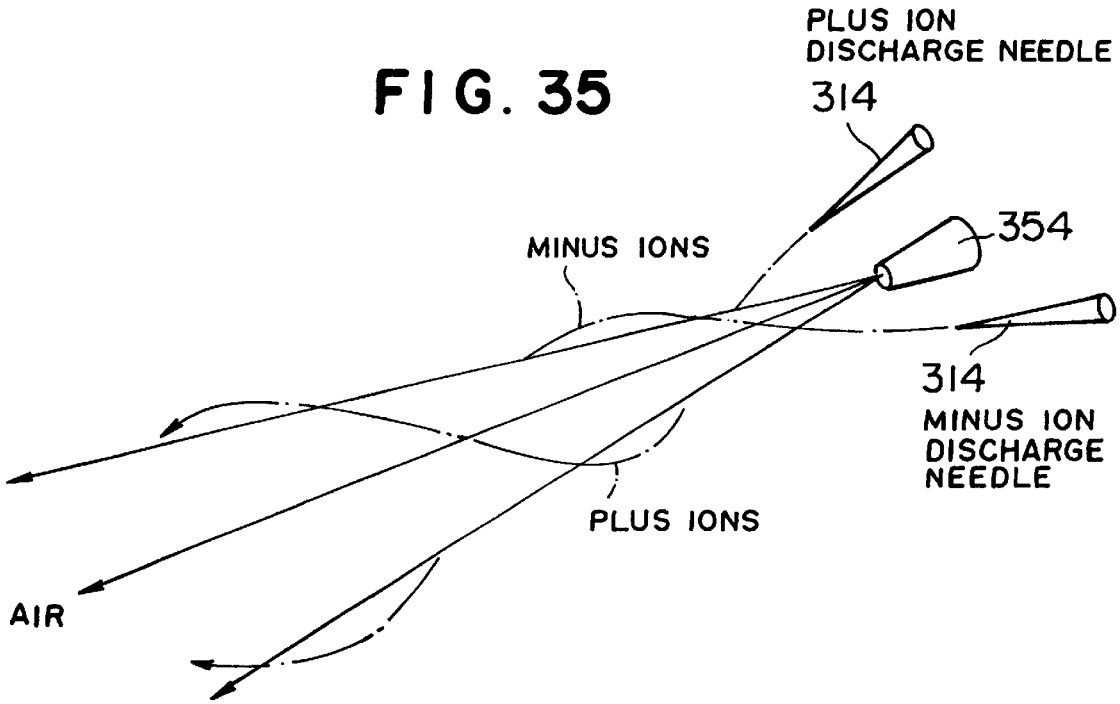
FIG. 35 is a perspective view showing the status that an ion stream is supplied around an air stream in a tornado pattern.

FIG. 35 shows the state that the stream of the ions is supplied so as to be moved in an tornado pattern relative to the air. This can be embodied by disposing the discharge needles 314, 314 to be declined in opposite directions at the both sides.

Figures 36A, 36B, 36C:
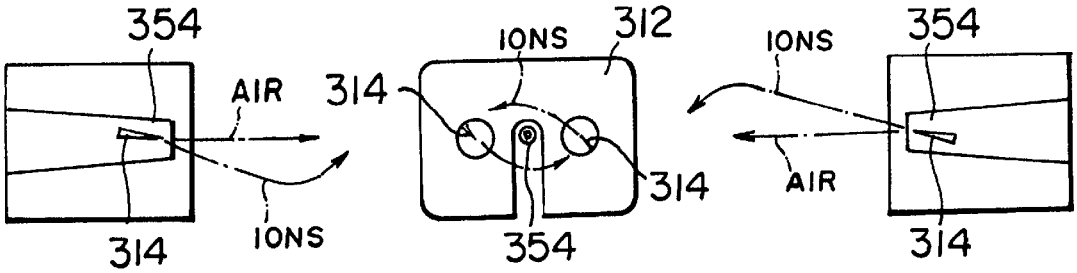
FIG. 36 is a view showing the positions of ion guns and an air gun when an ion stream is supplied in a tornado pattern.
Figure 36D:
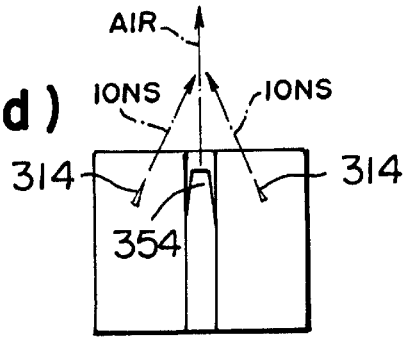

FIG. 36 shows that discharge needles are disposed right and left as to an air nozzle as the center point, when the stream of ions is supplied in a tornado pattern, and in FIG. 36, FIG. 36*a* is its front view, FIGS. 36*b* and 36*c* are left and right side views, and FIG. 36*d* is its bottom view. In this case, the left and right discharge needles are directed slightly oppositely, one needle directed slightly upward, and the other needle directed slightly downward.

Figures 37A, 37B, 37C:
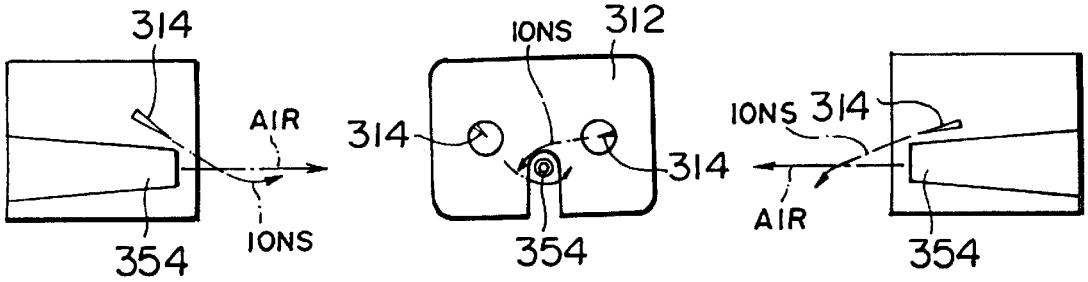
Figure 37D:
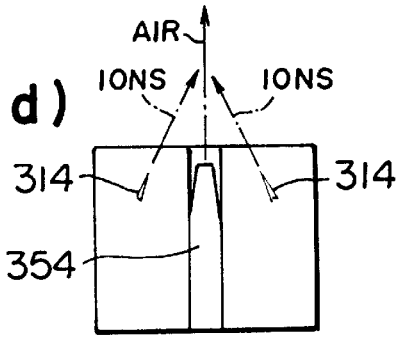

FIG. 37 shows that discharge needles are disposed when the stream of ions is supplied in a tornado pattern, and in FIG. 37, FIG. 37*a* is its front view, FIGS. 37*b* and 37*c* are left and right side views, and FIG. 37*d* is its bottom view. In this case that the air nozzle is not disposed in the center between the pair of discharge needles, the left and right discharge needles are disposed in a tangent direction of the air nozzle to make a tornado stream.

In the aforementioned construction, the electric system section and gun system section are separated and insulated from each other and, ions and air can be supplied in good mixed state.

Figure 38:
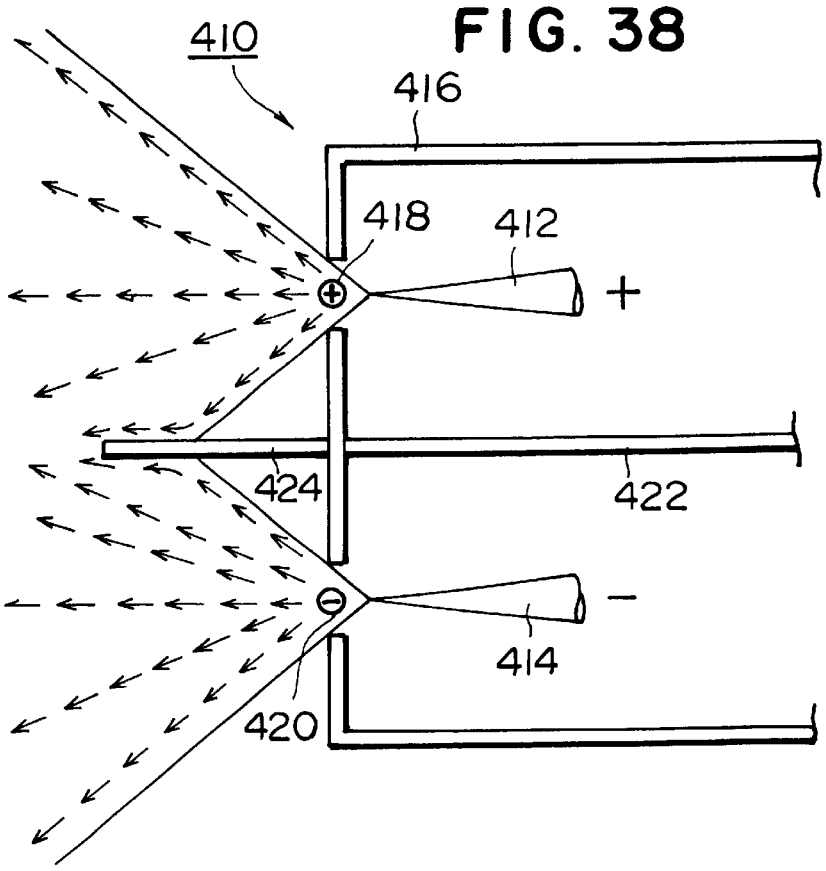
FIG. 38 is a cross-sectional view showing an embodiment of a static eliminator according to the present invention.
Figure 39:
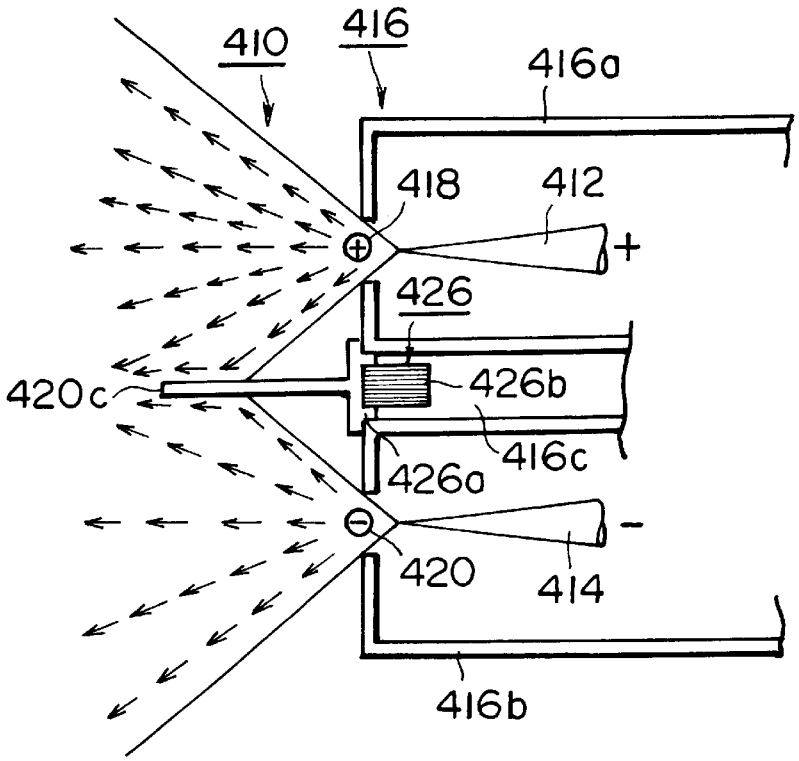
FIG. 39 is a cross-sectional view showing another embodiment of a static eliminator according to the present invention.
Figure 40:
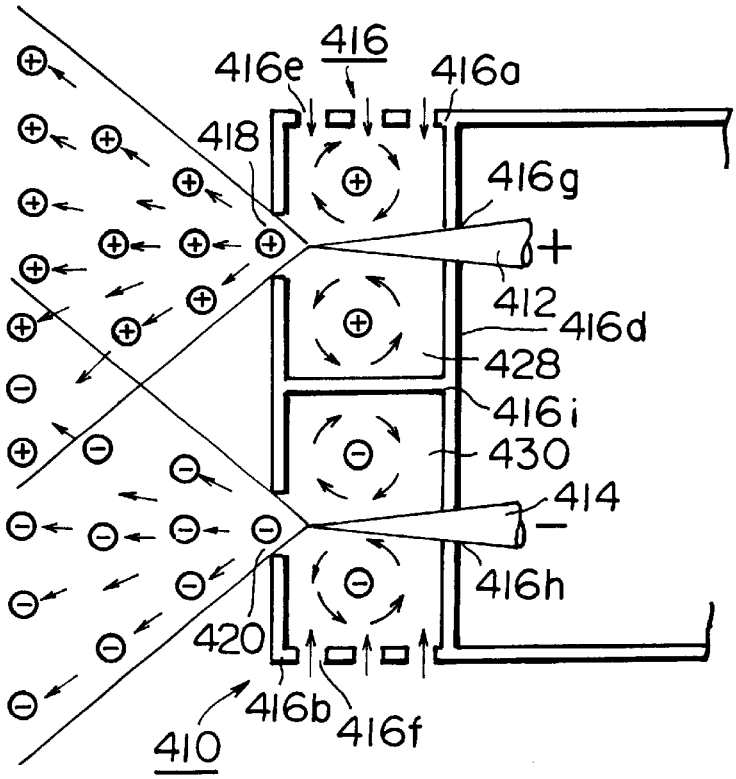
FIG. 40 is a cross-sectional view showing a still another embodiment of a static eliminator according to the present invention.
Figure 41:
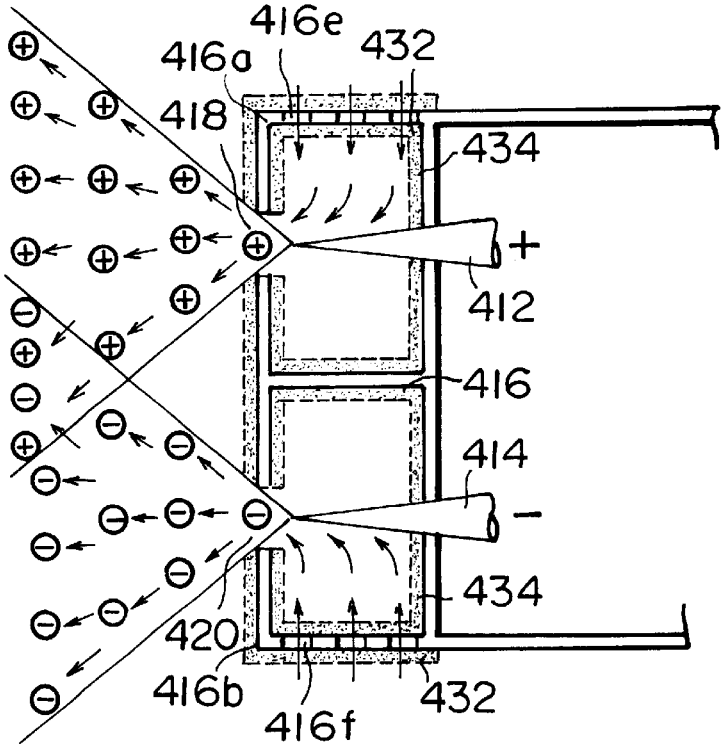
FIG. 41 is a cross-sectional view showing a still another embodiment of a static eliminator according to the present invention.
Figure 42:
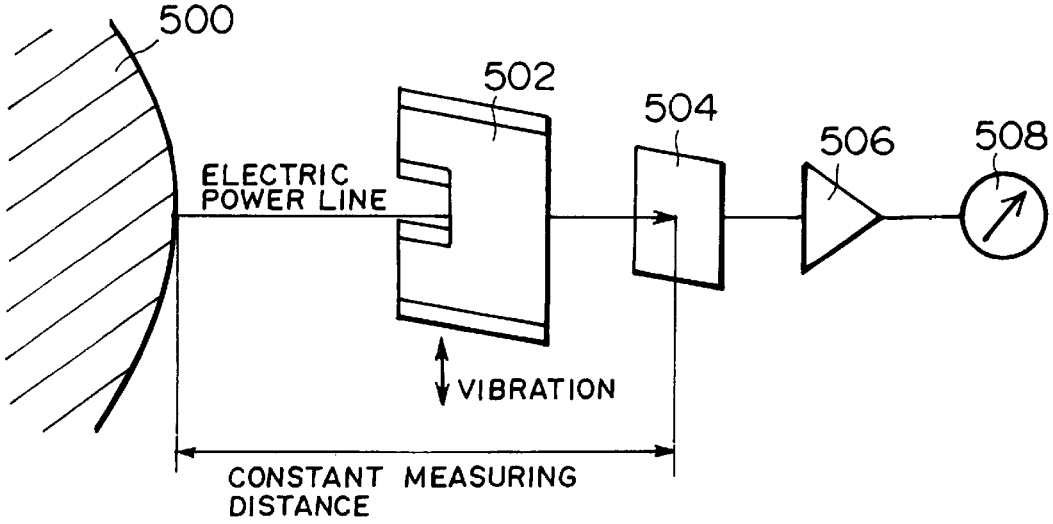
FIG. 42 PRIOR ART
FIG. 42 is a view for explanation on a conventional method of measuring static potential.
Figure 43:
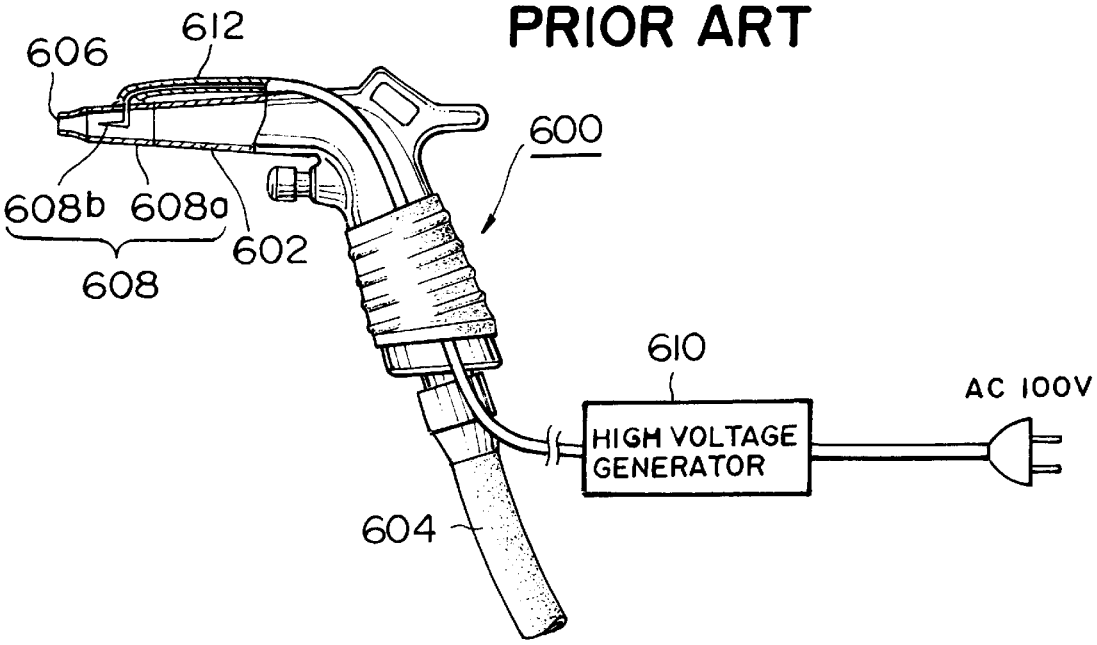
FIG. 43 PRIOR ART
FIG. 43 is a partial cross-sectional showing a conventional air-blow gun type of static eliminator.
Figure 44:
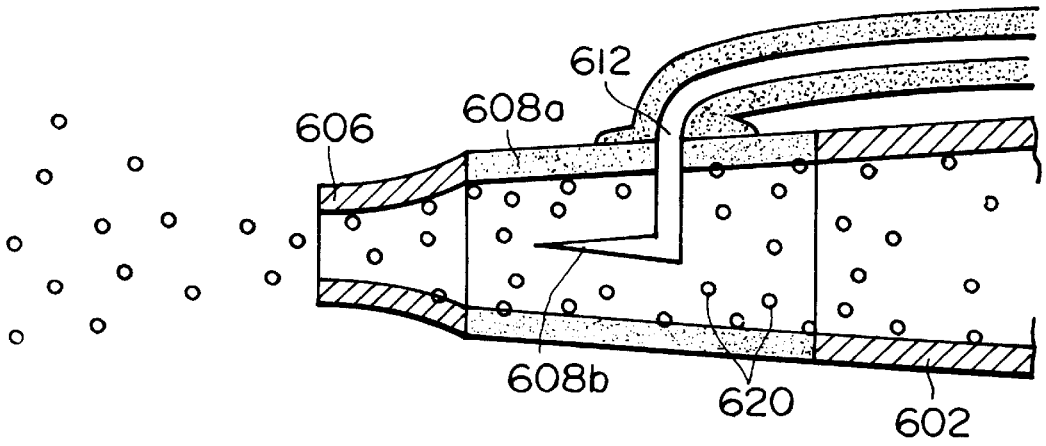
FIG. 44 PRIOR ART
FIG. 44 is a partial cross-sectional showing an electric section, that is, discharge electrode section of a conventional air-blow gun type of static eliminator.
Figure 45:
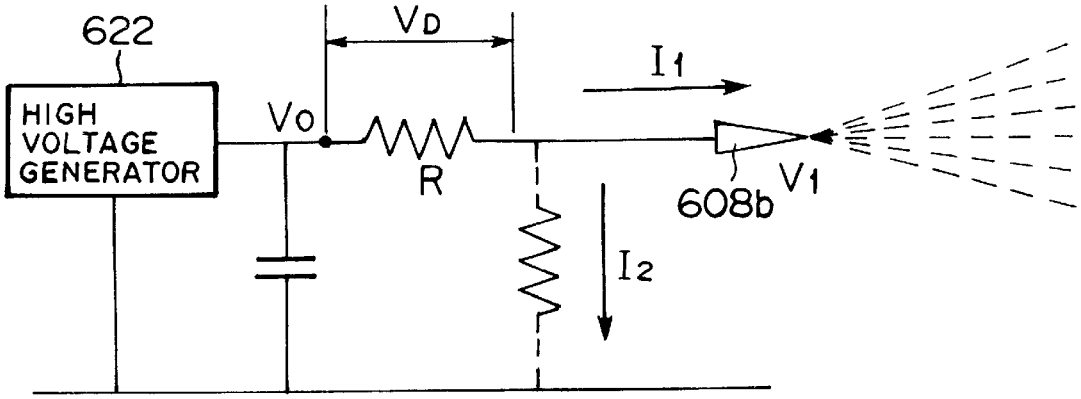
FIG. 45 PRIOR ART
FIG. 45 is a view of a model of electric circuit for explanation on an electric leakage at a conventional air-blow gun type of static eliminator.

FIG. 38 is a cross-sectional view showing an embodiment of static eliminator according to the present invention, FIG. 39 is a cross-sectional view showing another embodiment of static eliminator according to the present invention, FIG. 40 is a cross-sectional view showing a still another embodiment of static eliminator according to the present invention, and FIG. 41 is a cross-sectional view showing a still another embodiment of static eliminator according to the present invention.

As shown in FIG. 38, a static eliminator 410 includes a pair of a plus discharge needle 412 and a minus discharge needle 414. These discharge needles 412 and 414 are disposed inside of the case 416 so that ions are ejected outside through discharge openings 418 and 420 formed on the case 416. A partition plate 422 is provided inside of the case between the discharge needles 412 and 414. Outside of the case, a partition plate 424 is provided so as to partition plus ions and minus ions issued outside. Of course, although a partition plate may be provided merely inside of the case, it is advantageous that partition plates are provided both inside and outside of the case.

It is advantageous that the inside partition plate 422 completely partitions the inside of the case not to generate leakage, that is, not to form a gap. As the outside partition plate 424 is bigger, effect is bigger. However, since the electric field generated by the plus and minus discharge needles are inversely proportional to the distance squared, the effect of the partition plate is not significant at the point far away from the case. Therefore, it can be said that the outside partition plate may be formed to be big as long as there is not an obstacles. In the experiment, when the outside partition plate is 10 mm in length, reactive power is almost not significant.

As shown in FIG. 39, the static eliminator 410 includes a pair of plus discharge needle 412 and minus discharge needle 414. These discharge needles 412 and 414 are disposed inside of the case 416 so that ions are ejected outside through discharge openings 418 and 420 formed on the case 416. In the embodiment, the case 416 is formed of two case portions 416*a* and 416*b* so that it accommodates a plus discharge needle 412 and a minus discharge needle 414 in the each portion, respectively. Thus, needles 412 and 414 are completely partitioned.

A space 416 is provided between the front portions of the case portions 416*a* and 416*b*, and a discharge needle cleaning brush 426 is disposed in the space 416*c*. The brush 426 comprises a body 426*a*, bristle hairs 426*b* planted in the body 426*a*, and a shank portion 426*c* extending from the body 426*a* at the opposite side of the bristle hairs 426*b*. Since the stepped shape of the body 426*a* and the front shape of the space 416*c* are formed so as to be complement, the body of the brush 426 can be detachably disposed so that the bristle hairs 426*b* is disposed in the space 416*c*. In the state, the shank 426*c* of the brush 426 extends in the area where plus and minus ions issued from the plus and minus discharge needles 412 and 414 are contacted to prevent the neutralization of the plus and minus ions.

When the dust is attached to the discharge needles and thus the discharge effect is decreased, the bristle hairs 426*b* of the brush are caused to be contacted to the discharge needles 412 and 414 through the discharge openings 418 and 420 to clean the dust attached to the discharge needles.

As shown in FIG. 40, the static eliminator 410 includes a pair of plus discharge needle 412 and minus discharge needle 414. These discharge needles 412 and 414 are disposed inside of the case 416 so that ions are ejected outside through discharge openings 418 and 420 formed on the case 416. In the embodiment, the case 416 comprise two case portions 416*a* and 416*b* adjacent to each other. Each case portion 416*a* and 416*b* is closed to form a chamber 428 and a chamber 430 inside of the case, respectively. On the wall of one chamber 428, the aforementioned opening 418, an introducing openings 416*e* and a discharge opening 416*g* are formed. The discharge opening is provided so that only the leading end of the discharge needle is inserted in the chamber 428. In a similar manner, On the wall of the other chamber 430, the aforementioned opening 420, introducing openings 416*f* and a discharge opening 416*h* are formed. The discharge opening is provided so that only the leading end of the discharge needle is inserted in the chamber 430. Further, a partition wall 416*i* is provided between the chambers 428 and 430, as shown. Thus, since the leading ends of discharge needles are completely partitioned, the ions of opposite polarities generated by each discharge needles are not recombined.

Although the static eliminator in the embodiment is similar to the aforementioned static eliminator in construction as shown in FIG. 41, it is different from the above-mentioned static eliminator in that a filter for cleaning air or dust is provided. For convenience of explanation, only the different point will be explained. an outside filter 432 is provided outside of the case 416 and an inside filter 434 is provided inside of the case 416. Further, one of these filter may be provided. By providing the filter or filters, air is filtered through introducing opening 416*e* and 416*f* to capture the small dust in the air with the filter and clean the air.

Since the static eliminator uses a high voltage, it has a property of absorbing the small dust in the air. Since the stream of ions is generated by the discharging, the stream of air is induced. By utilizing the functions of absorbing dust and generating the stream of air, an air cleaning and static eliminator is obtained. Furthermore a conventional air cleaning instrument uses only plus or minus high voltage and absorbs the dust. On the other hand, the static eliminator according to the present invention has a discharge property of plus and minus opposite polarities. For this reason, the absorbing effect can be obtained regardless the polarity.

Since the static eliminator according to the present invention has an air cleaning or dust removing effects, the word "static eliminator" includes the air cleaning function as well as the static eliminating function itself and in use only the air cleaning purpose.

What we claim:

1. An air-blow gun type of static eliminator in which an electric system section having discharge needles for issuing ions and an air-blow gun system section having an air nozzle for ejecting air are configured so that the electric system section is formed independent electrically and construction ally from the air-blow gun system section by having an insulated case with a complementary shape that is detachably mounted in combination with the air-blow gun system section with its discharge needles positioned adjacent the air nozzle of the air-blow gun system section.

2. An air-blow gun type of static eliminator according to claim 1 wherein said electric system section and said air-blow gun system section are constructed so that the former is detachable from the latter.

3. An air-blow gun type of static eliminator according to claim 1 wherein the insulating case of said electric system section comprises upper and lower case pieces.

4. An air-low gun type of static eliminator according to claim 1 wherein the discharge needles in said electric system section and the air nozzle in said air-blow gun system section are disposed closely to make a good mixture of ions and air.

5. An air-blow gun type of static eliminator according to claim 1 wherein said discharge needles comprises a plus ion needle for issuing plus ions and a minus ion needle for issuing minus ions, and said air nozzle is disposed between said plus ion discharge needle and said minus ion discharge needle.

6. An air-blow gun type of static eliminator according to claim 1 wherein said discharge needles are disposed to be inclined to the direction of air ejected by air nozzle so that a good mixture of ions and air is made.

7. An air-blow gun type of static eliminator according to claim 1 wherein a plurality of discharge needles is disposed to be inclined to cross the ejected air and further inclined to generate a tornado pattern so that a good mixture of ions and air is made.

8. An air-blow gun type of static eliminator according to wherein a body of said air-blow gun system section is made in the form of gun and said electric system section is formed as a "C" in section and can be seated on said body of said air-blow gun system section.

* * * * *